US005894754A

United States Patent [19]

Sartorio

[11] Patent Number: 5,894,754

[45] Date of Patent: Apr. 20, 1999

[54] SYSTEM FOR PRODUCING BENT SHEET-METAL ARTICLES AND COMPONENTS OF THE SYSTEM

[75] Inventor: Franco Sartorio, Turin, Italy

[73] Assignees: Amada Company, Limited, Kanagawa, Japan; CREA S.r.l., Turin, Italy

[21] Appl. No.: 08/968,423

[22] Filed: Nov. 12, 1997

Related U.S. Application Data

[62] Division of application No. 08/637,748, Apr. 26, 1996.

[51] Int. Cl.[6] ..... B21D 43/10

[52] U.S. Cl. ..... 72/422; 72/424; 72/446; 483/14; 483/29; 901/17

[58] Field of Search ..... 72/446, 448, 422, 72/424; 294/86.4, 90, 91; 901/6, 15, 16, 17, 27–31, 41; 414/222, 225, 226, 732, 738, 776; 483/14, 15, 28, 29

[56] References Cited

U.S. PATENT DOCUMENTS

| | | | |
|---|---|---|---|
| 4,809,422 | 3/1989 | Kitamura | 29/568 |
| 4,852,242 | 8/1989 | Tella et al. | 901/41 |
| 4,860,428 | 8/1989 | Brolund et al. | 483/29 |
| 4,871,290 | 10/1989 | Kaczynski et al. | 901/30 |
| 4,991,422 | 2/1991 | Sartorio . | |
| 5,044,063 | 9/1991 | Voellmer | 901/30 |
| 5,178,032 | 1/1993 | Zona et al. | 901/29 |
| 5,271,686 | 12/1993 | Herring, Jr. et al. | 901/29 |
| 5,368,539 | 11/1994 | Mills et al. | 483/1 |
| 5,492,443 | 2/1996 | Crorey et al. | 901/15 |
| 5,669,866 | 9/1997 | Julian et al. | 483/29 |
| 5,697,480 | 12/1997 | Herbermann et al. | 901/29 |

FOREIGN PATENT DOCUMENTS

WO 92/12362 7/1992 WIPO .

OTHER PUBLICATIONS

International Search Report dated Feb. 3, 1995.

*Primary Examiner*—Joseph J. Hail, III
*Assistant Examiner*—Ed Tolan
*Attorney, Agent, or Firm*—Blank Rome Cominsky & McCauley LLP

[57] ABSTRACT

The system for producing bent sheet-metal articles comprises a bending machine (80) having a punch (84) and a die (86) which cooperate with each other and define a bending space, and a manipulator (64) having a movable head (76) which can grip a piece of sheet metal and place it in the bending space. Each piece to be bent has its own gripper and the head (76) of the manipulator (64) has rapid-attachment means for gripping and releasing the gripper associated with each piece. A table for defining the position of a piece to be bent, a manipulator for gripping and moving a piece of sheet metal by means of a floating head, a bending machine comprising an auxiliary structure for measuring the relative displacement of the punch and the die, and a device for automatically replacing tools of the bending machine are also described.

19 Claims, 24 Drawing Sheets

SYSTEM FOR PRODUCING BENT SHEET-METAL ARTICLES AND COMPONENTS OF THE SYSTEM

This is a divisional of co-pending application Ser. No. 08/637,748, filed Apr. 26, 1996, still pending.

TECHNICAL FIELD

The present invention relates to the production of bent sheet-metal articles and concerns an automatic bending system and some characteristic components of the system.

BACKGROUND ART

The invention has been developed to solve the problem of the bending of sheet-metal articles of complex shapes which are frequently used in machines such as photocopiers, facsimile machines and various electronic devices. These products are subject to rapid development and manufacturer therefore often changes models from one year to another. Each new model is the product of a redesign, even as regards the various sheet-metal articles which it contains.

These bent sheet-metal articles are therefore produced on a relatively small scale and thus do not justify complex and expensive tools and dies.

A system for producing bent sheet-metal articles known from U.S. Pat. No. 4,991,422 departs radically from previously existing bending systems which use bending presses with fixed frameworks and linear, V-sectioned punches and dies which are movable vertically towards and away from each other.

The system described in the U.S. Patent mentioned above provides for a piece which is to be bent to be supported by a manipulator so that a region of the piece which is to be bent lies in a vertical suspension plane. The bends are effected by means of an oscillating bending machine having two tools which can be disposed in any configuration relative to the piece to be bent. The piece is supported by the manipulator in a manner such that it can perform movements of limited extent with five degrees of freedom, excluding rotation about an axis perpendicular to the plane of the undeformed piece of sheet metal. The bending machine also has a device for the rapid replacement of the tools, using two rotary turrets carried at the ends of a C-shaped tool-holder structure.

DISCLOSURE OF INVENTION

The object of the present invention is further to develop the bending system, the essential elements of which are described in the aforementioned U.S. Pat. No. 4,991,422, and to improve some of the components of the system which have a critical role in the practical application of this innovative bending system.

The object of the invention is achieved by means of a system and by means of devices having, essentially, the characteristics defined in the claims.

The present invention will now be described in detail with reference to the appended drawings, provided purely by way of non-limiting example, in which:

BRIEF DESCRIPTION OF DRAWING

FIGS. 2 to 4 show in section, in elevation, and in plan, a gripper for fitting on to a piece of sheet metal, FIG. 5 is a plan view of the table indicated by the arrow V in FIG. 1, FIG. 6 is a schematic section taken on the line VI—VI of FIG. 5, FIG. 7 is a longitudinal section of the part indicated by the arrow VII in FIG. 5, FIG. 8 is a section of the part indicated by the arrow VIII in FIG. 7, on an enlarged scale, FIGS. 9, 10 and 11 are schematic views showing the part indicated by the arrow IX in FIG. 5, on an enlarged scale, FIGS. 12 is a schematic view showing the operating principal of the suspension head, FIG. 13 is a perspective view of the suspension head, FIGS. 14 and 15 are schematic, longitudinal sections of the head of FIG. 13 taken in two perpendicular section planes, FIG. 16 is a section similar to that of FIG. 15 with the addition of clamping devices, FIGS. 17 and 18 are sections, on enlarged scale, of the part indicated by the arrow XVII in FIG. 16, showing the device for the engagement of a gripper, FIG. 19 is a section showing the clamping device indicated by the arrow XIX in FIG. 18, on an enlarged scale, FIG. 20 is a schematic, perspective view of the bending machine, FIGS. 21 and 22 are elevational and plan views of the bending machine, FIG. 23 is a partial section taken on the arrow XXIII—XXIII of FIG. 22, FIG. 24 is a section taken on the line XXIV—XXIV of FIG. 23, FIG. 25 is a detail of the part indicated by the arrow XXV in FIG. 21, on an enlarged scale, FIGS. 26 and 27 are sections taken on the line XXVI—XXVI of FIG. 25, showing the device for the rapid engagement of the tools, FIG. 28 is a schematic, perspective view of the gripping head, FIG. 29 is a partially-sectioned side view of the gripping head, FIG. 30 is a view taken on the arrow XXX of FIG. 29, FIG. 31 is a partial view of the tool store, from above, taken on the arrow XXXI of FIG. 1, FIG. 32 is a section taken on the line XXXII of FIG. 30, on an enlarged scale, and FIGS. 33, 34, 35 and 36 are schematic views showing the sequence for replacing a pair of tools of the bending machine.

BEST MODE FOR CARRYING OUT THE INVENTION

The system for producing bent sheet-metal articles and the devices making up the system will now be described with reference to the drawings.

A System For Producing Sheet-Metal Articles

Figure 1:
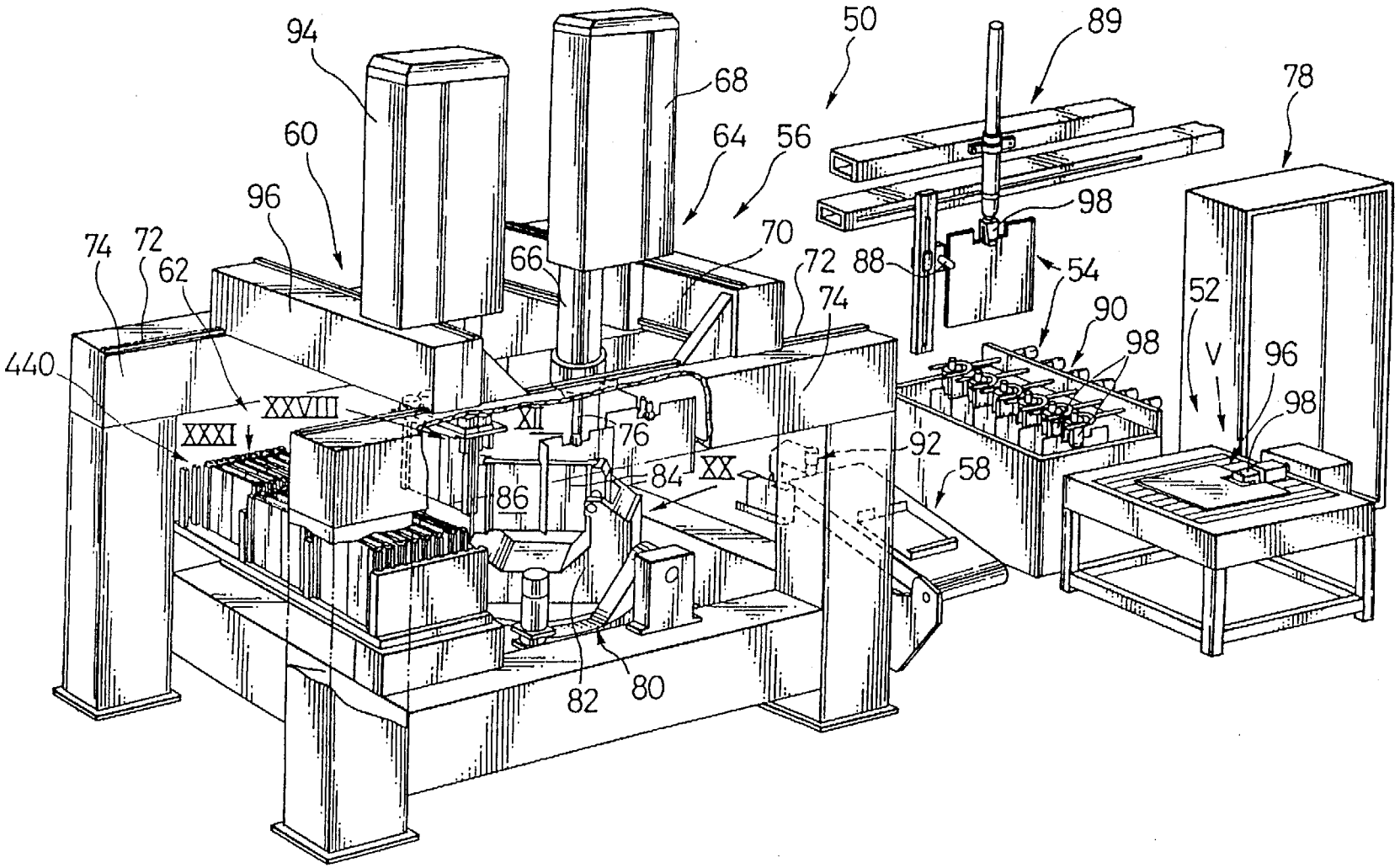
FIG. 1 is a schematic, perspective view showing a system according to the invention as a whole.

With reference to FIG. 1, a system for producing bent sheet-metal articles from blanked or laser-cut pieces of sheet metal of shapes corresponding to the development in a plane of the articles to be produced, is generally indicated 50.

The system 50 comprises a station 52 for positioning the pieces of sheet metal, a measurement and storage station 54, a bending station 56, an output station 58 and a device 60 for the automatic replacement of the tools, with a respective tool store 62.

The bending station 56 comprises a cartesian manipulator 64 including a vertically-movable device 66 carried by a carriage 68 movable along a beam 70 which in turn is movable along guides 72 of a portal structure 74. The movable device 66 of the manipulator 64 carries a suspension head 76 which will be described in detail below, for holding vertically, by means of a gripper, a piece of sheet-metal to be bent.

An important characteristic of the system according to the present invention is constituted by the fact that the gripper is not connected to the suspension head of the manipulator 64, but is connected to the piece to be bent.

The suspension head 76 of the manipulator 64 has the characteristic that it supports the piece in a manner such that it floats freely, so that the piece is free to perform movements of a limited extent during bending.

In order to execute each bend, the manipulator 64, which is controlled by a conventional control unit 78, positions the piece in a position which is determined on the basis of a program established in dependence on the geometrical shape of the piece to be worked.

The bending station 56 also comprises a bending machine 80 comprising a tool-holder structure 82 having a punch 84 and a die 86 which cooperate with each other. As will be described in detail below, the tool-holder structure 82 is rotatable about an axis which passes through the bending line defined by the vertex of the V-shaped punch 84 and can also pivot about a horizontal axis perpendicular to the aforesaid axis of rotation. It will therefore be appreciated that the punch 84 and the die 86 can be disposed in any position relative to the piece to be bent.

The rotary and pivoting movements of the tool-holder structure 82 are brought about by the control unit 78 on the basis of a predetermined program.

It is important to underline that the precision of the positioning of the piece in space, like the precision of the positioning of the tools, is of decisive importance since, unlike conventional bending methods, there are neither mechanical abutments to define the position of the piece nor systems for measuring the position of the piece relative to the bending machine.

The necessary precision in the positioning of the piece is achieved by virtue of a preliminary determination of the relative piece-manipulator position and of the precise control of the relative manipulator-bending machine positions, which is achieved by virtue of the operating precision of the manipulator 64 and of the bending machine 80.

The operating principle upon which the bending system according to the invention is based thus consists of the positioning of a piece of sheet metal in a predetermined region in space with great precision and repeatability, and of the modification of the positions of the bending tools relative to the piece, with a corresponding degree of precision and repeatability, by a movement of the bending machine, so as to execute the bend in the desired region. For further clarification as regards the operating principle of the system according to the present invention, reference should be made to U.S. Pat. No. 4,991,422.

The main characteristic of the system according to the present invention is its ability to work on extremely small batches (even a single piece) of pieces with different geometrical shapes, solely by means of the selection of a different working program, without carrying out tooling operations. A first problem which had to be solved in order to achieve a high degree of flexibility of the system was that of devising a unit for loading the pieces which enabled shaped pieces of sheet metal of complex shapes and extremely variable dimensions to be stored and subsequently gripped by the suspension head 76 of the manipulator 64.

With conventional grippers carried by the head of the manipulator, in addition to the difficulty of producing a universal gripper which can grip pieces of different geometrical shapes, there is the problem of the precise positioning of the piece relative to the gripper and hence relative to the locating system of the manipulator, that is, the problem of how to position the piece precisely on a loading device which, at the same time, can be adapted to pieces which differ greatly in shape and size.

In the system according to the present invention, these problems have been overcome by virtue of the fact that each piece is associated with its own gripper which is fitted on to a predetermined region of the undeformed piece of sheet metal. The gripper is fitted on to the piece of sheet metal in the positioning station 52 in the manner which will be described in detail below. The pieces, with their respective grippers, are disposed in a store 90 to await transfer to the bending station 56. The store 90 can easily house pieces of different geometrical shapes without the need for any tooling, by virtue of the use of the gripper.

In fact, the store 90 can accommodate a certain number of grippers which are inserted in a corresponding number of forks forming part of the store. The pieces of sheet metal, each gripped by its own gripper, are disposed vertically, suspended by the gripper itself, and thus have no direct connection with the store 90 which is completely independent of the shapes of the sheets.

After each piece of sheet metal has been provided with its gripper, the piece is subjected to a measurement step carried out by means of a conventional feeler 88. The data detected by this measurement are processed and stored by the control unit 78 which establishes the link which exists between a locating system fixed relative to the piece and a locating system which is fixed relative to the gripper and, consequently, is fixed relative to the suspension head 76 of the manipulator 64. Small corrections can thus be made to the program controlling the manipulator 64 to compensate for errors in the positioning of the piece relative to the gripper.

The piece may be measured when it is already connected to the suspension head 76 of the manipulator 64. In this case, the feeler 88 must be movable in order to enter and leave the working area. If the cycle for the working of the piece provides for the gripping region to be changed after some bends have been effected, a new measurement can be made after the piece has been gripped in the new position.

Alternatively, and as shown in FIG. 1, the measurement may be effected outside the working area, without affecting the time taken by the bending cycle, whilst the piece is supported by an auxiliary manipulator 89.

An alternative could be that of ensuring sufficient precision in the positioning of the piece relative to the gripper at the moment when the gripper is fitted on to the piece so as to avoid the measurement step altogether. Upon completion of the bending operations, the manipulator 64 brings the worked article to an output station 58, shown schematically by means of a belt conveyor. There may be a device 92 in the output station 58 for removing the grippers from the sheet-metal articles.

The device 60 for replacing the tools of the bending machine 80 is constituted by a cartesian robot having a carriage 94 movable on a beam 96 which in turn is movable on the guides 72 of the portal structure 74. The characteristics of the tool-gripping head of the device for the automatic replacement of the tools, as well as the method for the automatic replacement of one or both of the tools of the bending machine 80 will be described below.

The Table For Defining The Position Of A Piece To Be Bent

As has been seen above, each piece to be bent is fitted with its own gripper. This step is carried out on a table, indicated 96 in FIG. 1, for defining the position of a piece.

Figure 2:
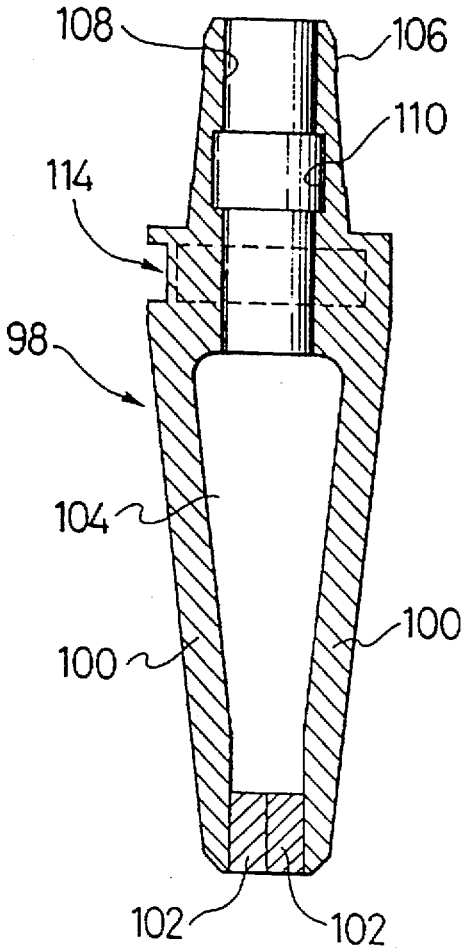
FIGS. 2 to 11 show a table for defining the position of a piece to be bent and, more precisely.
Figure 3:
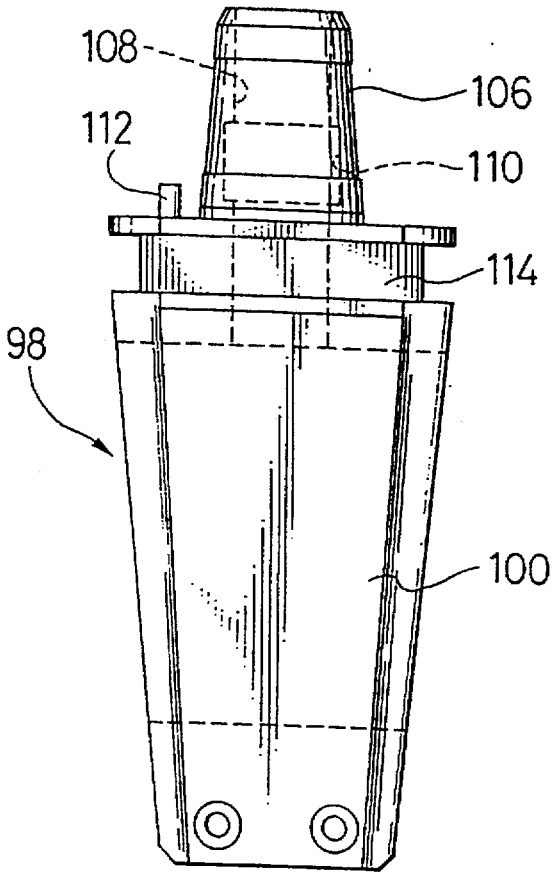
Figure 4:
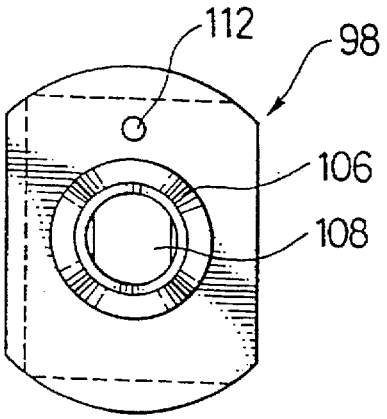

Before the structure and operation of the positioning table 96 are described, the gripper, which is shown in FIGS. 2, 3, and 4 and indicated 98, will be described.

The gripper 98 is a purely passive element, that is, it does not have opening and closure mechanisms of its own. The gripper 98 is constituted by a monolithic metal body having two resilient arms 100, to the ends of which two plates of frictional material 102, between which a piece of sheet metal can be gripped, are fixed. A cavity 104 (FIG. 2) is defined between the two arms 100 for housing a mechanism for moving the arms 100 apart resiliently. The gripper 98 has a shank 106 with a tapered outer surface for engagement on the suspension head of the manipulator. The shank 106 has a through-hole 108 which communicates with the cavity 104 and has a seat 110 for engagement by means which connect the gripper 98 to the manipulator head. The gripper 98 also has a pin 112 for the angular location of the gripper relative to the manipulator head and a groove 114 for engagement by a retaining device when the gripper is fitted on a piece of sheet metal.

Although the gripper just described is advantageous because of its structural simplicity, grippers of other types, even with mechanical closure, could be used. An alternative type of gripper could be constituted by one fixed arm and one movable arm which could be tightened against the fixed arm by means of a screw operated by an external device independent of the gripper.

As explained above, the gripper 98 has to be fitted on to the piece of sheet metal to be bent in a predetermined position. According to the present invention, this is achieved by virtue of a positioning table 96 which has a device for holding a gripper 98 in a predetermined region of the table 96. The table 96 also has means for defining a position for the location of the piece of sheet-metal relative to the table 96.

Figure 5:
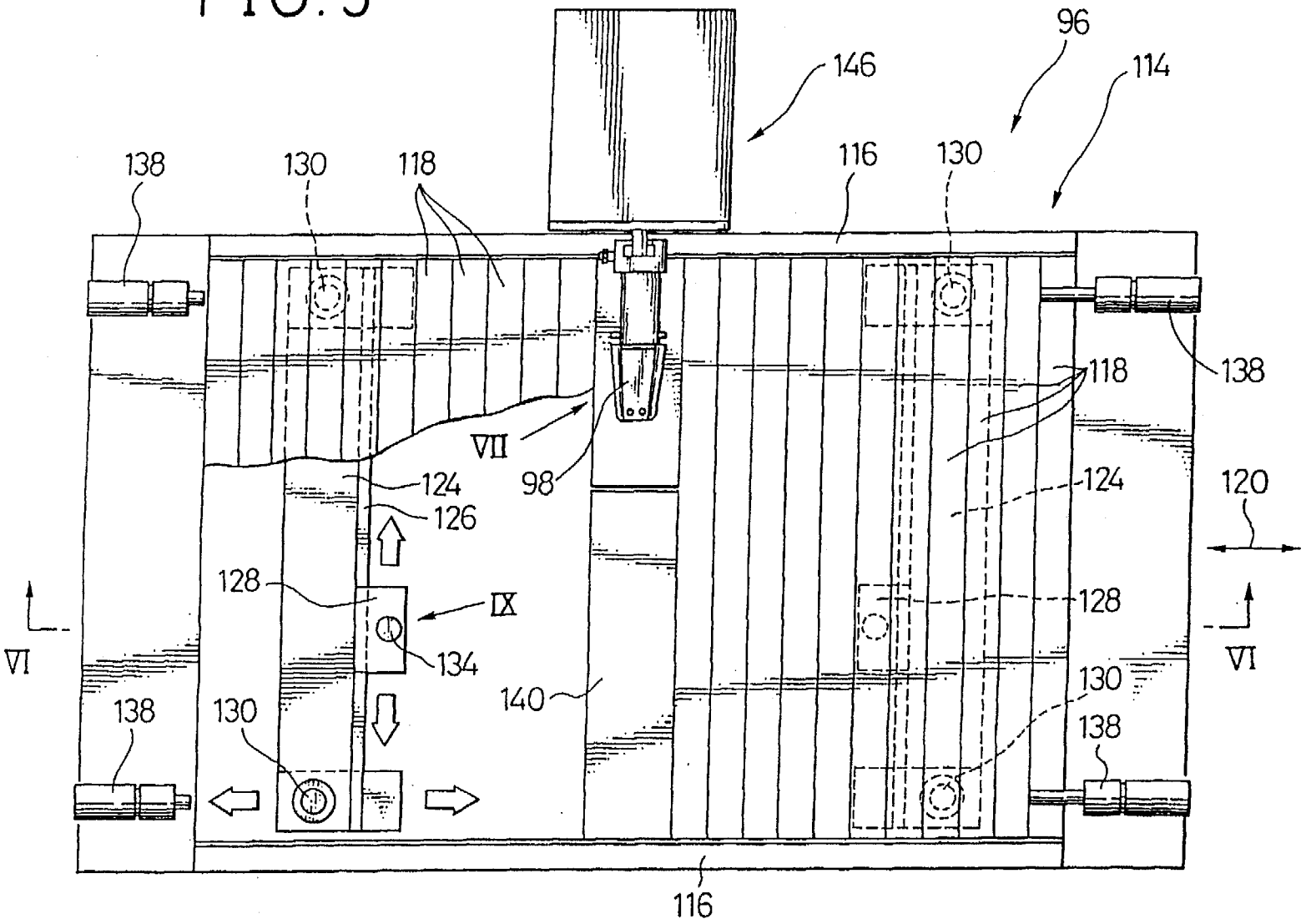
Figure 6:
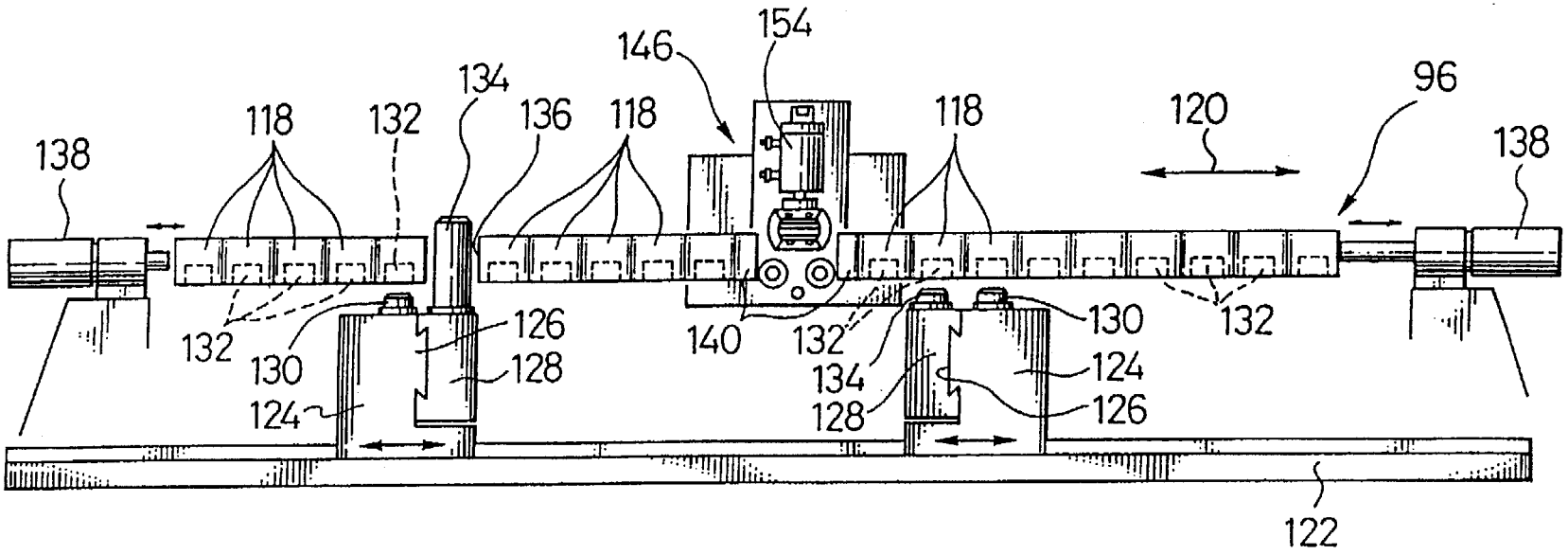

FIGS. 5 and 6 show a preferred embodiment of the table 96 in which the locating means are in the form of abutment elements projecting from the surface which supports the piece. Any mechanical or optical system which can define a position for the location of the piece is intended, however, to fall within the scope of the present invention.

With reference to FIGS. 5 and 6, a fixed support structure of the table 96 is indicated 114. The structure 114 has an upper rectangular frame on two sides of which there are parallel guides 116 between which the ends of a plurality of elongate elements 118 are engaged for sliding freely, the elements 118 defining a support plane for a piece of sheet metal to be positioned. The elongate elements 118 can slide freely independently of each other in the directions indicated by the double arrow 120.

As can be seen in greater detail in FIG. 6, a pair of guides 122 is disposed transversely beneath the elongate elements 118 and two cross-members 124, parallel to the elongate elements 118 and having their own conventional movement means (not shown), are slidable thereon.

The two cross-members 124 have respective guides 126 which are parallel to the elements 118 and along each of which a carriage 128 having its own movement system, is slidable.

Again with reference to FIG. 6, each cross-member 124 has a pair of vertically-movable pins 130 which can engage respective seats 132 in the lower portions of the elongate elements 118.

Each carriage 128 has an abutment element 134 which can travel vertically relative to the carriage. As can be seen in the left-hand portion of FIG. 6, each article element 134 is intended to project above the support surface of the table 96 through a slot 136 formed by the separation of two sets of elongate elements 118.

The support structure 114 of the table 96 carries four thrust actuators 138 which act on the elongate elements 118 and compact them against a central fixed cross-member 140.

A position for the location of a piece of sheet metal on the support surface of the positioning table 96 is created as follows.

The abutment elements 134 are brought to their lowered configuration (see the right-hand portion of FIG. 6) in which they do not interfere with the elongate elements 118. The four actuators 138 are then operated and compact the slidable elements 118 towards the centre of the table. The pins 130 of the cross-members 124 are then brought into correspondence with the longitudinal element 118 situated in the region of the table 96 in which the slot 136 for the passage of the abutment element 134 is to be created. When the cross-members 124 are in the correct positions, the pins 130 are raised so as to engage the seats 132 in the element 118. The actuators 138 are then brought to their retracted, inoperative positions and the cross-members 124 are moved outwardly relative to the table, creating the slot 136 through which the abutment element 134 can extend. After the slot 136 has been created, the carriage 128 of each cross-member 124 is moved along the slot until it reaches a predetermined point on the support surface. When a piece of sheet-metal is disposed, manually or by means of an automatic manipulator, on the support surface of the table 96, the position of the piece of sheet-metal relative to the table is thus determined univocally by the two abutment elements 134.

If the pieces are positioned on the table manually, there will be a display unit (not shown) in the vicinity of the table 96 to show the operator the correct orientation of the piece.

Figure 9:
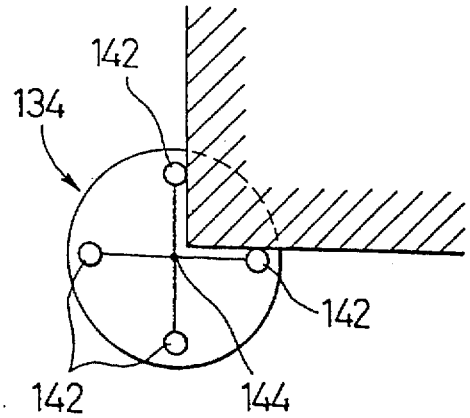
Figure 10:
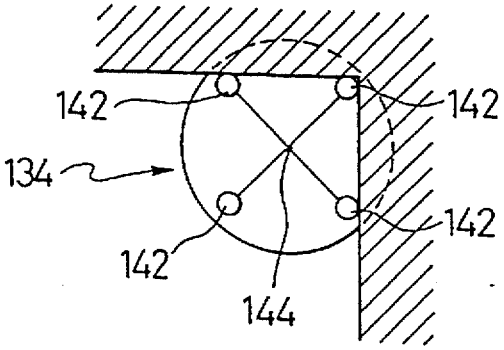
Figure 11:
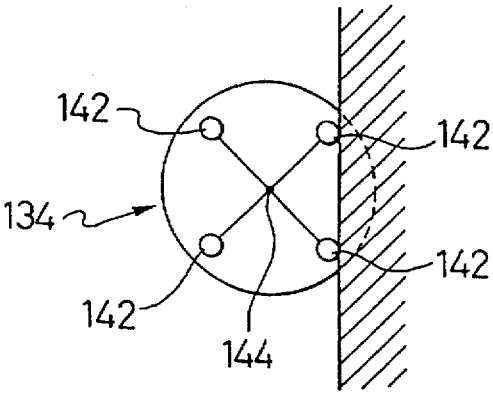

In order to improve the precision of the positioning of the piece of sheet-metal, each abutment element 134 has four parallel pins 142, as shown schematically in FIGS. 9, 10 and 11. The four pins 142 are perpendicular to the surface supporting the piece and are rotatable together, with a stepped movement, about an axis 144 perpendicular to the plane of FIGS. 9 to 11. Each abutment element 134 can thus serve for the positioning of a corner of the piece of sheet-metal (FIG. 9), of an angle (FIG. 10), or of a flat edge (FIG. 11). Naturally, the number of pins 142 could be other than four, since the same function can be achieved by any number of pins greater than two.

As an alternative to the system described above for positioning the pieces with the use of mechanical abutments, an optical system consisting of the projection of a shadow or an image of a shape corresponding to that of the piece to be positioned onto the support surface cold be used.

For large batches, the table 96 may be replaced by a jig which can be fitted out, for example, with fixed pins arranged manually.

A device for fitting a gripper 98 on to a piece of sheet-metal positioned in the manner described above, is schematically indicated 146 in FIGS. 5 and 6.

Figure 7:
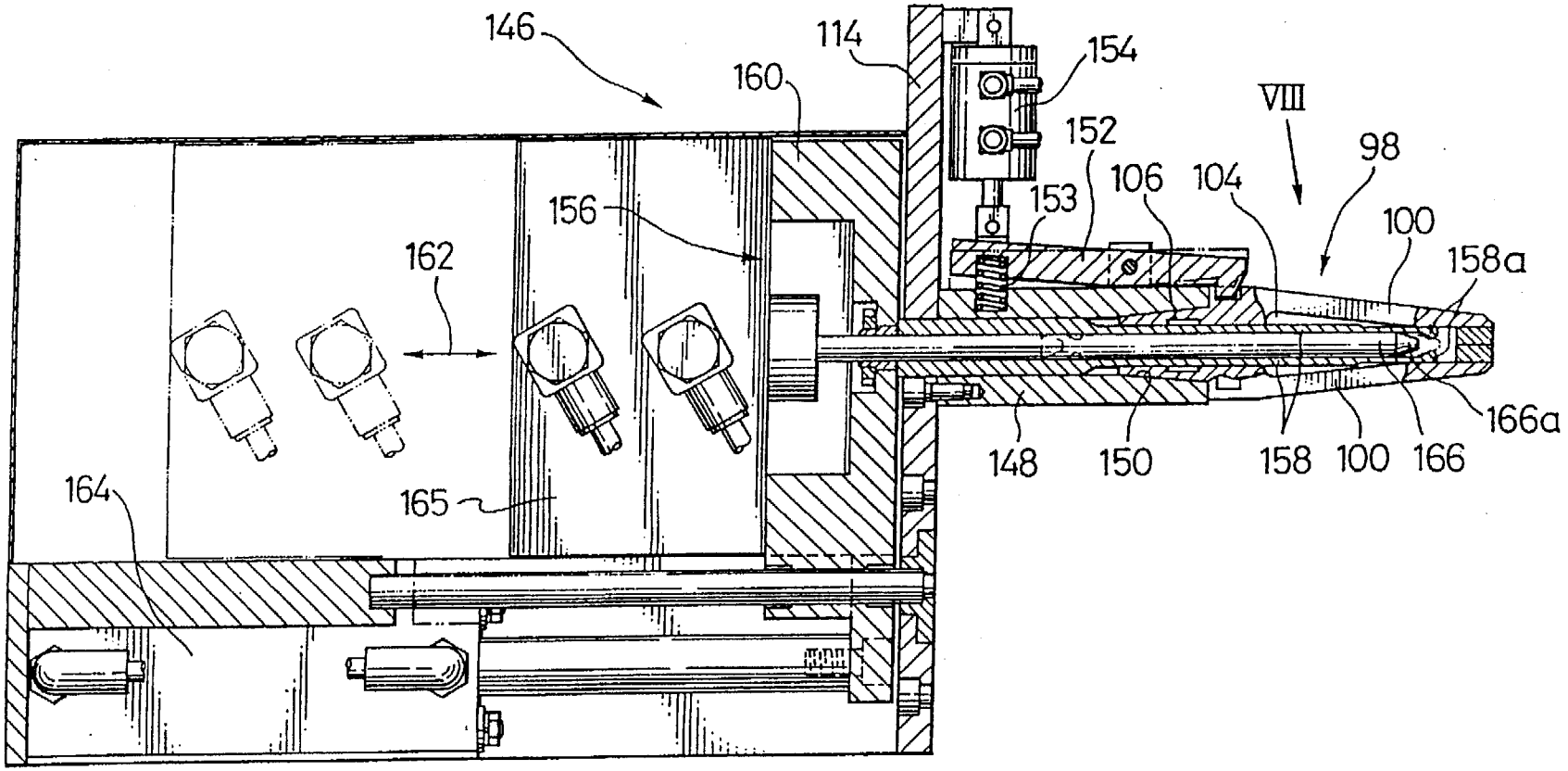

As can be seen in greater detail in FIG. 7, the device 146 comprises a tubular element 148, fixed to the structure 114 of the table 96, for holding a gripper 98. The tubular element 148 has a conical seat 150 for housing the shank 106 of the gripper 98 and carries a rocker arm 152 which engages the groove 114 of the gripper 98. The rocker arm 152 is kept in the engagement position by a spring 153 and is associated with a release actuator 154. The device 146 comprises a device 156 for moving the resilient arms 100 of the gripper 98 apart. The device 156 comprises a pair of spreader arms 158 formed with protrusions **158*a* and carried by a body 160 which is movable in the directions indicated by the double arrow 162 and is operated by an actuator 164. A rod 166 formed with tapered sections 166*a* extends between the two spreader arms 158 and can perform an axial movement of limited length relative to the arms. As will be described in detail below, the tapered sections 166*a* are engageable with the protrusions 158*a*. The rod 166 is connected to a second actuator 165 carried by the body 160**.

The operation of the first actuator 164 inserts the rod 166 and the spreader arms 158 in the cavity 104 of the gripper 98 until they reach the position shown in FIG. 7.

Figure 8:
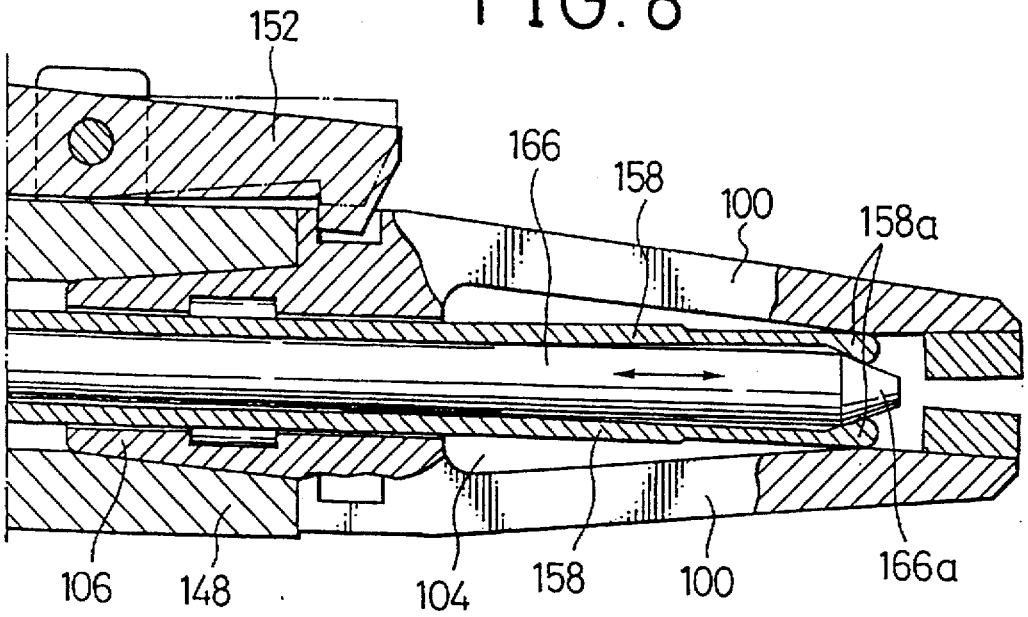

The operation of the second actuator 165 then slides the rod 166 relative to the spreader arms 158 as shown in FIG. 8 so as to move the arms 158 apart and open out the resilient arms 100 of the gripper 98. The gripper is closed again under the effect of the resilient return of the arms 100 by the retraction of the rod 166 by means of the second actuator 165. It should be noted that, by virtue of the system for moving the arms 158 apart by means of the slidable rod 166, no axial force is exerted on the gripper, which would be undesirable, but only spreading forces are exerted thereon.

After the gripper 98 has been fitted on a piece of sheet metal, the gripper is released by the retraction of the spreader arms 158 and the rod 166 by means of the actuator 164 and, finally, the locking of the rocker arm 152 by means of the actuator 154.

The Manipulator For Gripping And Moving A Piece Of Sheet Metal

In the description of the system for producing bent sheet-metal articles, it has been seen that, after the pieces of sheet metal have been provided with their own grippers, and after they have been subjected to a measurement step, they are moved by a manipulator which positions them precisely in a working region.

The suspension head 76 of the manipulator, that is, the portion of the manipulator which collects the gripper 98 (which is fixed rigidly to the piece), with the movable device 66 of the manipulator, is a critical component of the operating system which has to perform two conflicting tasks. In fact, whereas, on the one hand, the suspension head has to ensure a rigid connection between the gripper for gripping the piece and the movable device of the manipulator so that the piece can be positioned precisely in the working space, on the other hand, during the execution of the bend, the suspension head must leave the piece free to perform slight movements and rotations induced during bending so as not to strain the gripper 98 and the movable device 66 of the manipulator.

Figure 12:
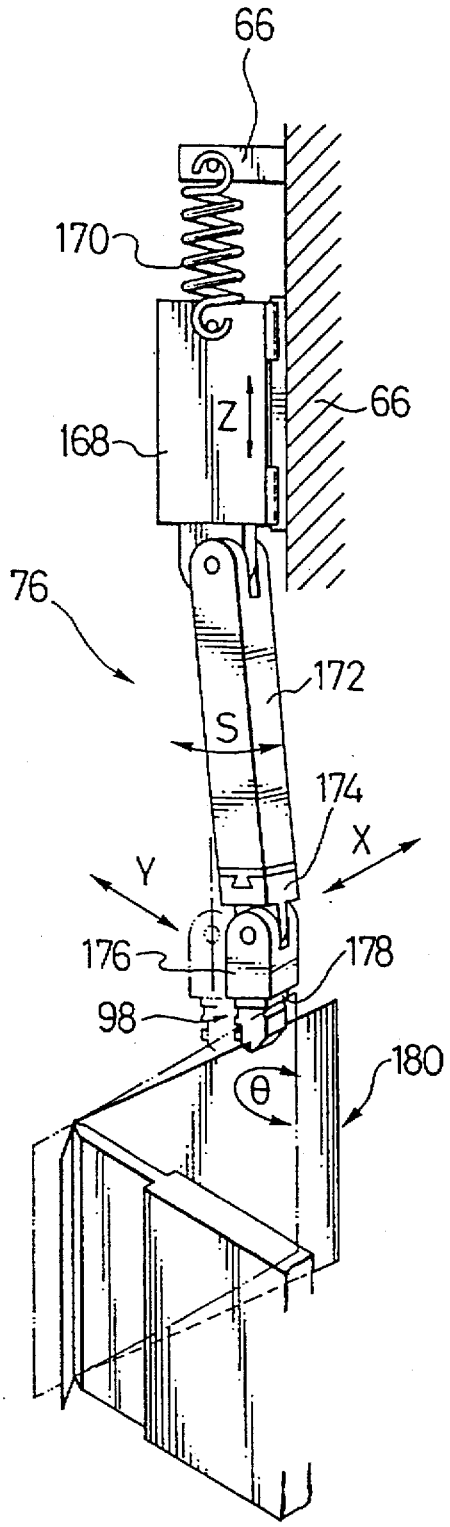
FIGS. 12 to 19 show the suspension head, indicated by the arrow XII in FIG. 1, of a manipulator for sheet-metal pieces and, more precisely.

FIG. 12 shows schematically the kinematic behaviour of the suspension head 76. The movable device 66 of the manipulator carries a suspension body 168 by means of resilient weight-compensation means indicated 170. A first pivoting element 172 is articulated to the suspension body 168 and carries, at its lower end, a slide 174 which is movable along the axis X. A second pivoting element 176 is articulated to the slide 174 and carries a rotary body 178 having means for engaging the gripper 98 which is fixed to a piece of sheet metal 180 to be bent.

The arrangement described allows the piece of sheet metal 180 five degrees of freedom constituted by three translatory movements along the axes X, Y and Z, a rotary movement about the axis Z and a pivoting movement about the axis X. The piece of sheet metal 180 remains restrained, however, with respect to the last degree of freedom constituted by rotation about the axis Y, which has to be prevented to avoid errors in the positioning of the bending line in the plane of the piece (the plane X–Z). It should be noted that the translation along the axis Y is composed of two pivoting movements of the pivoting elements 172 and 176.

The suspension head 76 can be restrained with respect to all the degrees of freedom by means of the clamping and biasing devices for returning the various elements 168–178 constituting the suspension head to a predetermined attitude.

Figure 13:
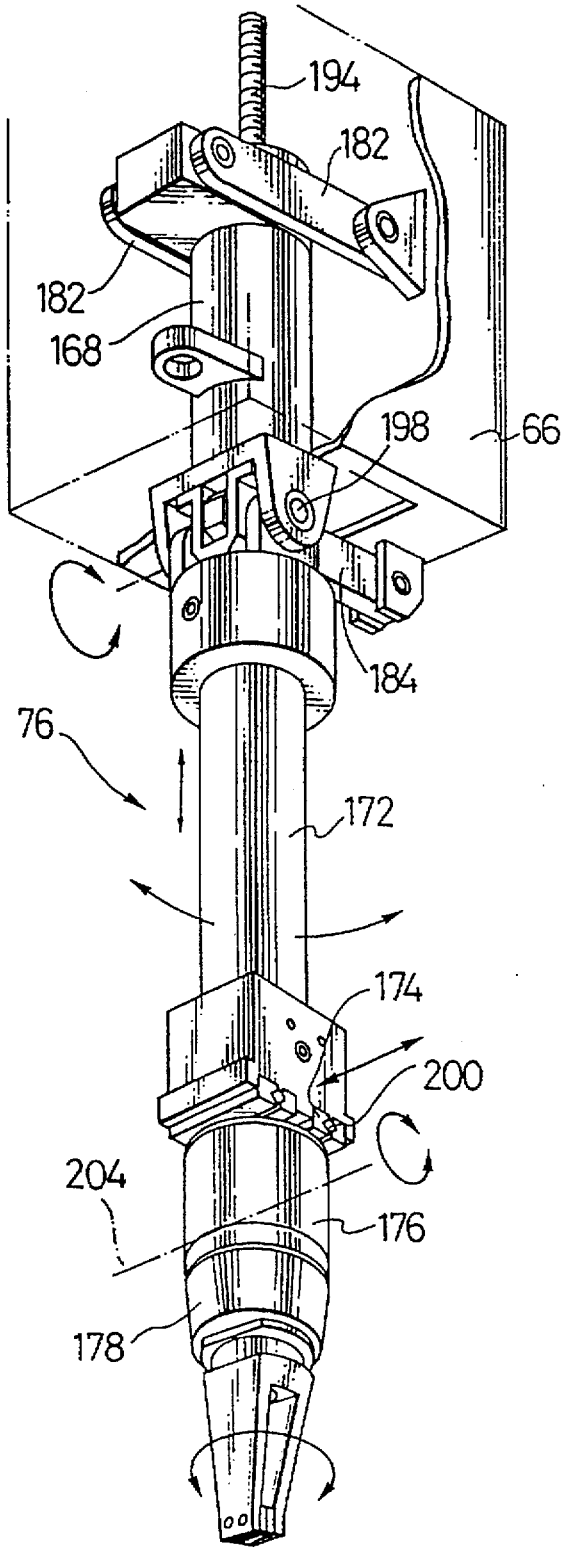
Figure 14:
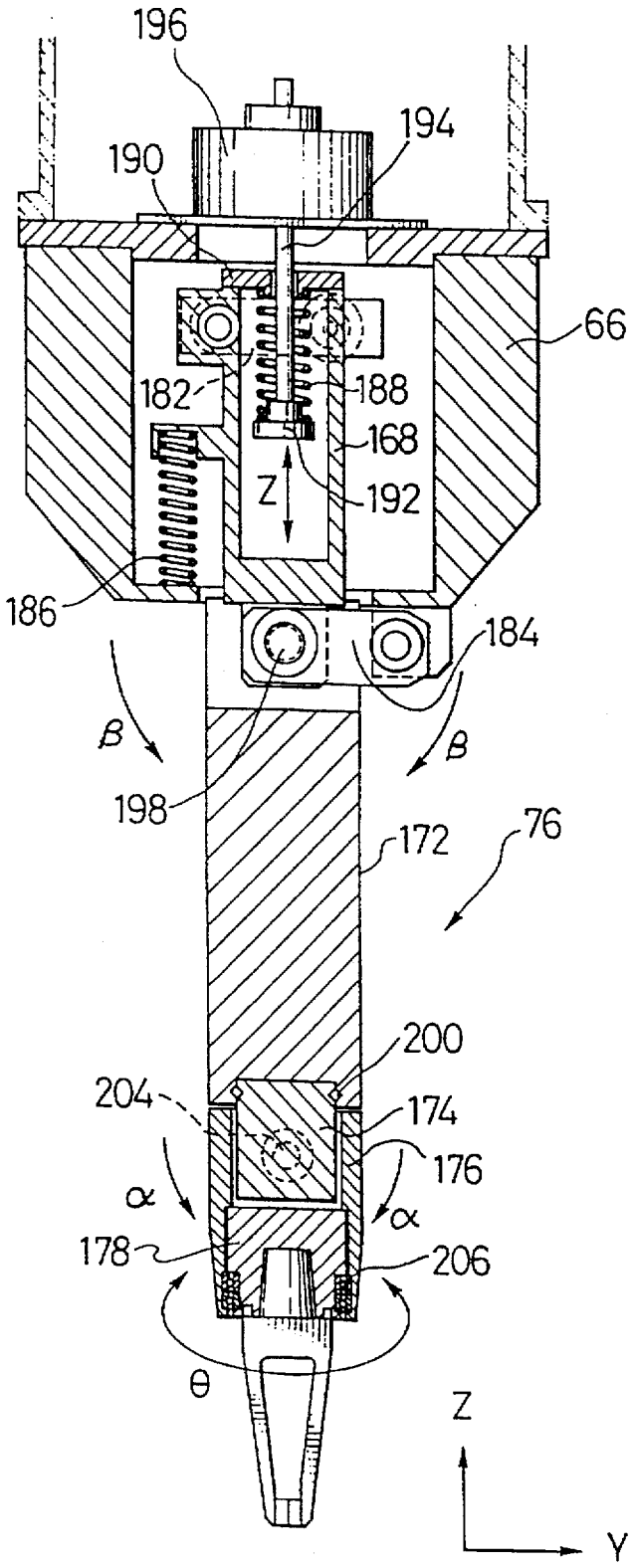
Figure 15:
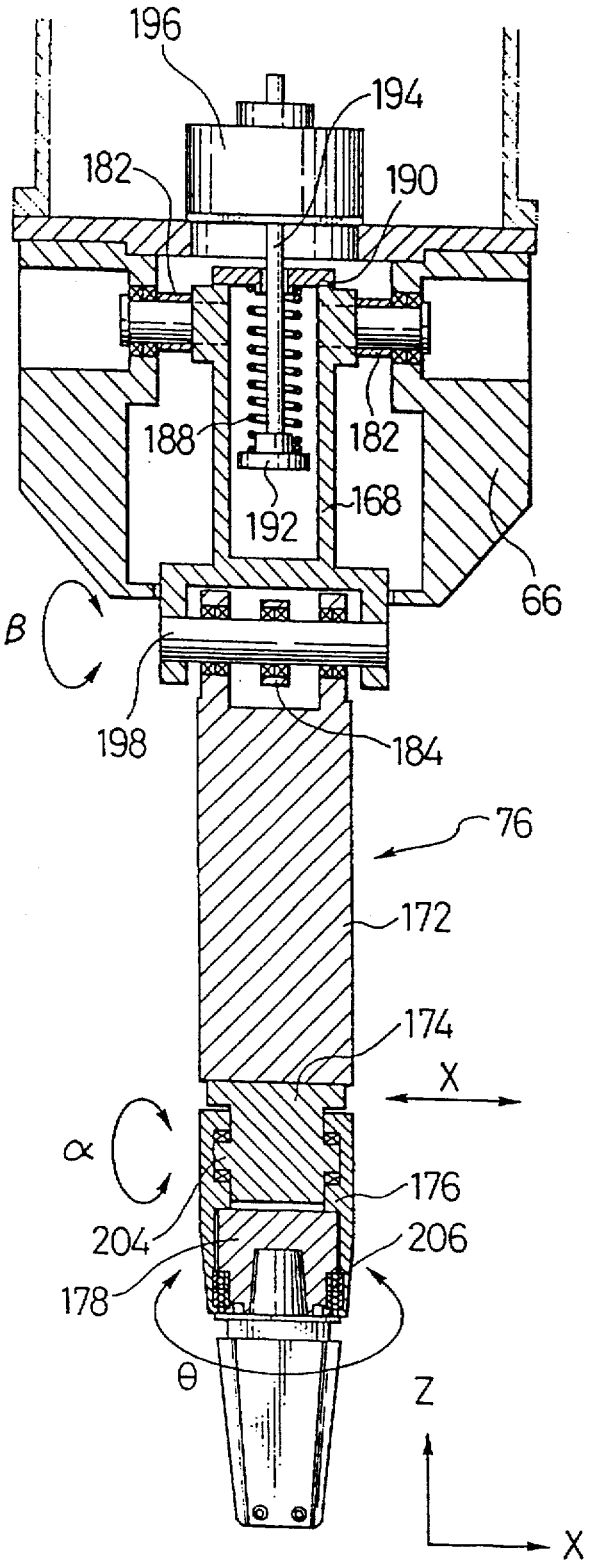

FIGS. 13, 14 and 15 show schematically a practical embodiment of the suspension head, the kinematic layout of which corresponds to FIG. 12.

The suspension body 168 is guided vertically relative to the movable device 66 by means of a four-bar linkage mechanism comprising a pair of upper connecting rods 182 and a lower connecting rod 184 which are articulated to the suspension body 168 and to the movable device 66 on parallel axes.

With reference, in particular, to FIG. 14, the resilient balancing means comprise a first spring 186 interposed under compression between the suspension body 168 and the movable device 66, and having a fixed preloading determined so as to balance the weight of the suspension head 76. A second spring 188 is disposed under compression in parallel with the first spring 186 and has a preloading which is variable according to the weight of the piece of sheet-metal 180 connected to the suspension head 76. The second spring 188 is interposed between an upper plate 190 fixed to the suspension body 168 and a head 192 carried by a rod 194 movable along the axis Z and operated by a motor 196 controlled by the control unit of the system, to which data relating to the weight of the pieces to be worked have been supplied beforehand.

The first pivoting element 172 is articulated at its upper end on a pin 198 which also acts as an articulation pin for the lower connecting rod 184 of the four-bar linkage mechanism which guides the vertical movement of the suspension body 168. At its lower end, the pivoting element 172 carries a linear guide 200 formed by a roller sliding block extending parallel to the axis of the pin 198 (that is, along the direction (X)). The guide 200 is engaged by the slide 174, which carries a pivot pin 204 which is parallel to the axis of the pin 198 and on which the second pivoting element 176 is articulated. The second pivoting element 176 supports the rotary body 178 by means of bearings 206 with vertical axes.

Figure 16:
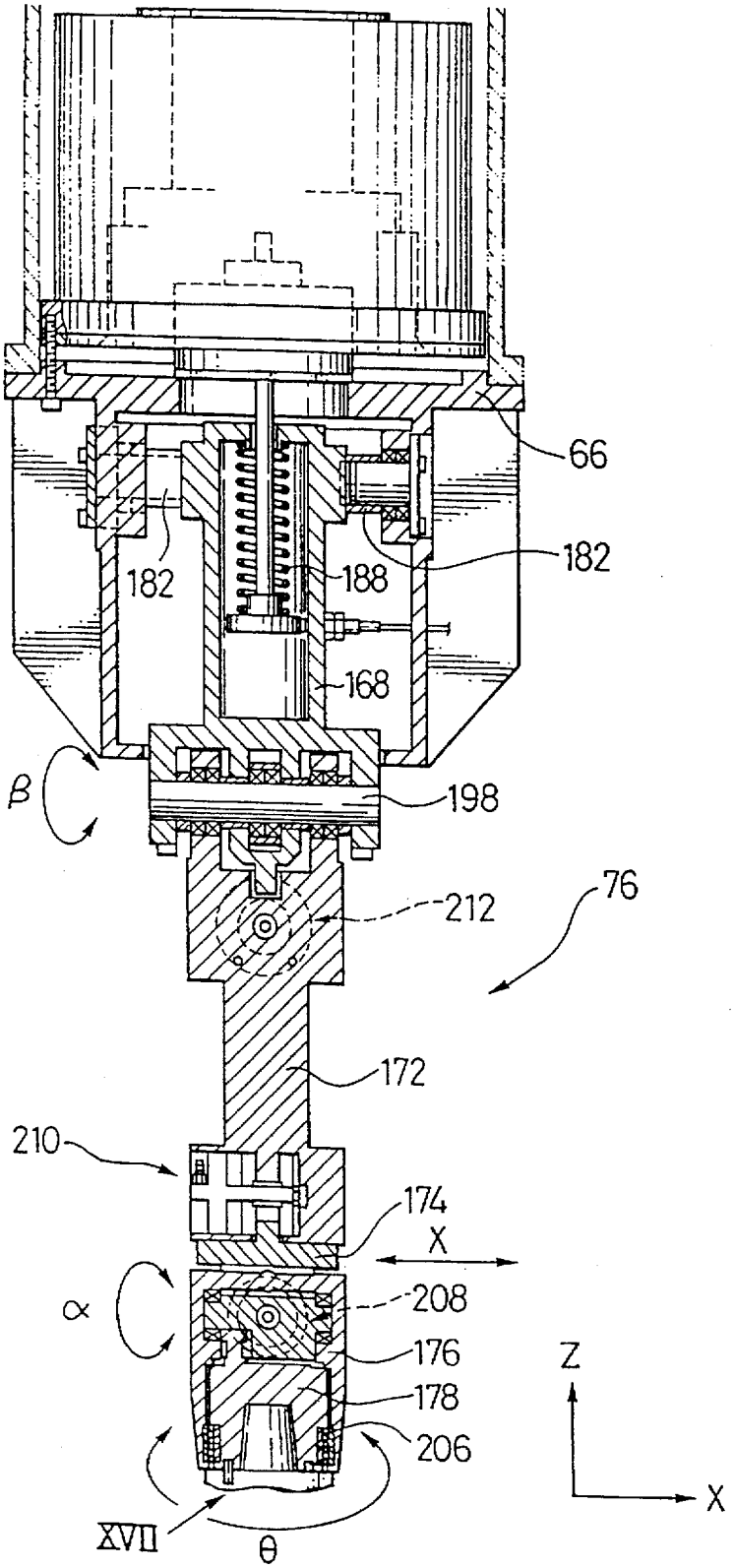

With reference now to FIG. 16, a first clamping device, indicated 208, can simultaneously achieve restraint with respect to two degrees of freedom, that is, rotation about the axis X and rotation about the axis Z. The clamping device 208 is housed in the body of the slide 174 and cooperates with the second pivoting element 176 and with the rotary body 178.

A second clamping device 210 is interposed between the first pivoting element 172 and the slide 174 for achieving restraint with respect to the degree of freedom corresponding to movement along the axis X.

A third clamping device 212 is interposed between the first pivoting element 172 and the suspension body 168 for restraining the element 172 from pivoting about the pin 198. Finally, a fourth clamping device (not visible in FIG. 16) is interposed between the suspension body 168 and the movable device 66.

The various clamping devices have essentially identical structures and are based on the principle of the gripping between two movable discs a part fixed to a relatively fixed element and a part fixed to a relatively movable element.

The structure and operation of the second clamping device 210 will be described with reference to FIGS. 18 and 19.

The clamping device comprises first and second pistons 214 and 216 which are connected to each other by means of a shaft 218 and are mounted for sliding in an airtight manner in a chamber 220 in the first pivoting element 172. A third piston 222 is slidable in a fluid-tight manner both relative to the chamber 220 and relative to the shaft 218. The second and third pistons 216 and 222 act by means of spherical surfaces 224 on respective thrust discs 226 and 228 which are kept separated by a pair of springs 230 and 232.

A first region 234 for supply with pressurized fluid (in the specific embodiment, compressed air) is defined between the first and third pistons 214, 222, and a second region 236 for supply with pressurized fluid is defined between the second piston 216 and an end face of the chamber 220.

Between the two thrust discs 226, 228 is a portion 238 which forms part of the first pivoting element 172 and in which two calibrated locating pins 240, disposed at 120°, are slidable to keep the opposed faces of the thrust discs 226, 228 a predetermined distance apart.

The slide 174 carries rigidly an appendix 242 having a calibrated head 244 which is interposed between the thrust discs 226, 228.

When no pressurized fluid is sent to the supply regions 234, 236, the thrust discs 226, 228 are kept in the retracted positions by virtue of the springs 230, 232 and do not exert any restraint on the head 244, and the slide 174 is therefore free to move on the guide 200 along the axis X.

In order to clamp the slide 174 with respect to its freedom to move along the axis X, pressurized fluid is supplied to the two supply regions 234, 236 at the same pressure. If the force produced by the pressure acting on each piston is indicated F (the force F is the product of the pressure of the fluid and the surface area of the piston exposed to the pressure), a force equal to 2F will act on the first thrust disc 226, urging it in the direction of the arrow 246, since the forces acting on the first piston 214 and on the second piston 216 are discharged on the first thrust disc 226 by means of the surface 224. A force of magnitude F will act on the second thrust disc 228, urging it in the direction indicated by the arrow 248, due to the action of the piston 222 alone. The first thrust disc 226 thus adopts a stable locating position against the locating surface 238, whilst the second thrust disc 228 presses the calibrated pins 240 and the calibrated head 244 against the first thrust disc 226.

The slide 174 is thus brought to a predetermined position which is defined with great repeatability relative to the first pivoting element 172 and remains clamped in that position as long as fluid continues to be supplied to the regions 234, 236.

The structure and operation of the rest of the clamping devices are identical to those described with reference to the second clamping device 210 with the sole difference that, in the first clamping device 208, two calibrated heads and a single calibrated pin 240 are disposed between the thrust discs 226 and 228, the heads being disposed in angularly offset positions, one head being fixed to the pivoting element 176 and the other to the rotary body 178, so that the operation of the first clamping device simultaneously clamps the second pivoting element 176 and the rotary body 178 and positions them in a predetermined attitude.

The device for connecting a gripper 98 to the suspension head 76 will now be described with reference to FIGS. 17 and 18. This device is generally indicated 250 and comprises a piston 252 which is slidable in a fluid tight manner in a chamber 254 in an element 256 which forms part of the rotary body 178. The rotary element 178 has a conical seat 258 for housing the shank 106 of the gripper 98. This piston 252 carries six gripping fingers 260 of which only two are visible, which can be moved apart resiliently, and are coaxial with the conical seat 258. Each finger 160 is formed at its lower end with a protrusion 260*a* having a tapered surface 260*b*. On the inside of the engagement fingers 260, there is a shaft 262 which is fixed to the element 256. The engagement fingers 260 are intended to engage the seat 110 of the gripper 98 in their spread-out configuration (shown in FIG. 18).

A helical compression spring 264 is interposed between the rotary body 178 and the piston 252. Two chambers, formed on opposite sides of the piston 252 for supply with pressurized fluid are indicated 266 and 268 respectively.

Figure 17:
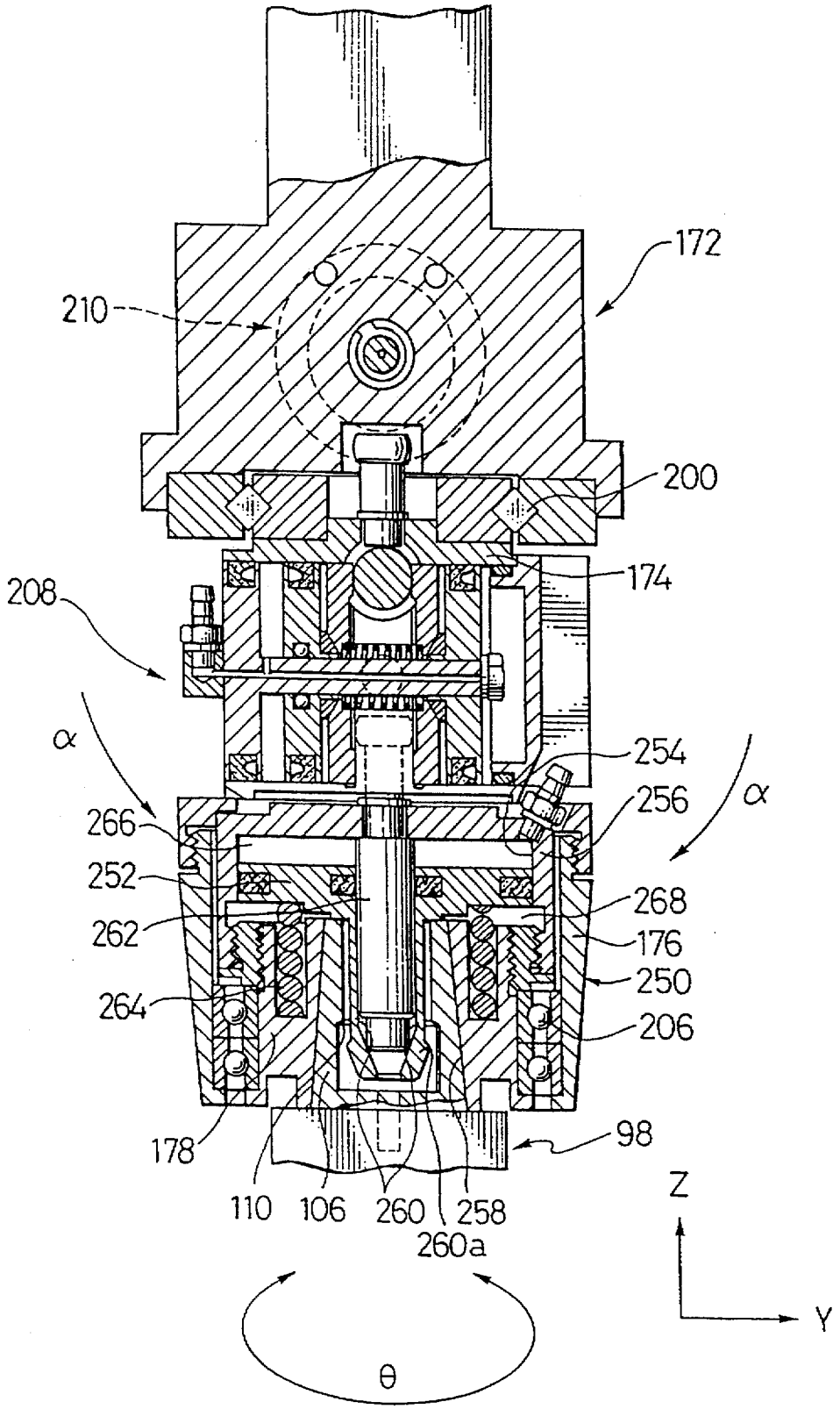

In the configuration of FIG. 17, the piston 252 is kept in its lowered position against the thrust of the spring 264 by the pressure of the fluid supplied to the upper chamber 266. In this configuration, the engagement fingers 260 are undeformed and are free of engagement with the seat 110 of the gripper 98 which can therefore be released from the suspension head by a relative movement along the axis Z.

Figure 18:
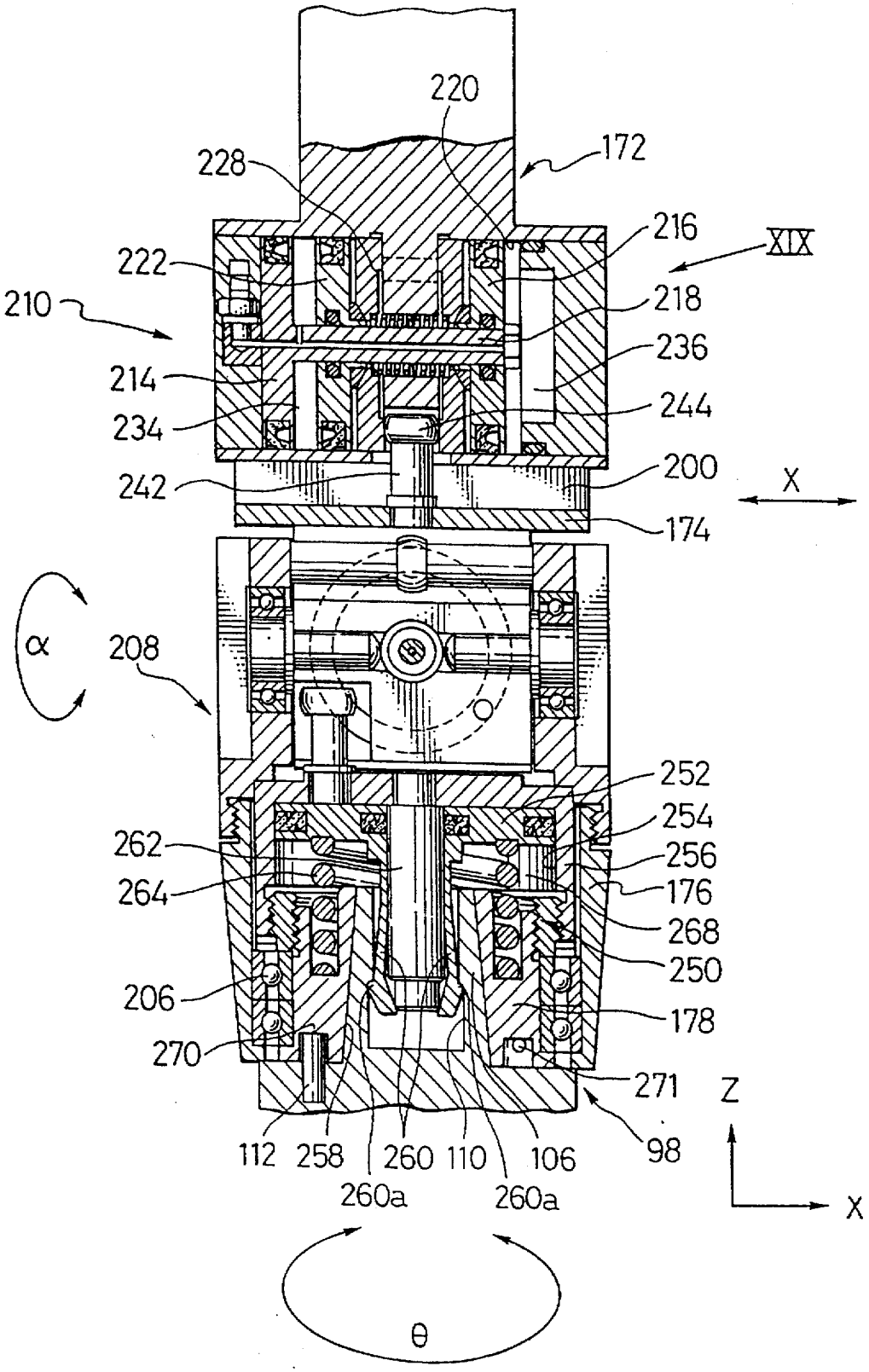
Figure 19:
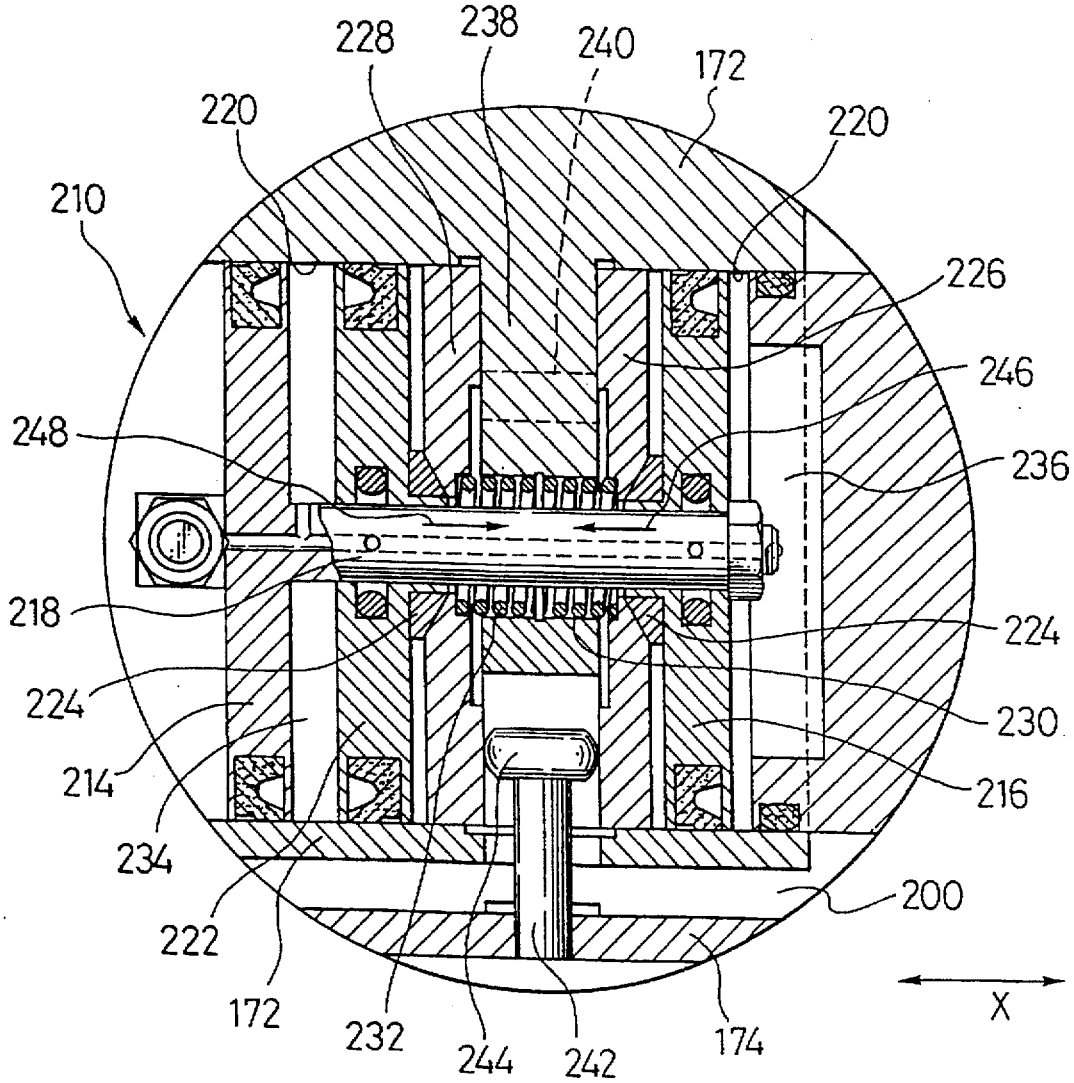

The clamping configuration of the connecting device 250 is shown in FIG. 18. In this configuration, the pressurized fluid is sent into the chamber 268 and the force of the fluid is added to the thrust of the spring 264. The engagement fingers 260 are moved apart due to their reaction against the shaft 262 and the protrusions 260*a* engage the seat 110, connecting the gripper 98 firmly to the rotary body 178. It should be noted that the engagement fingers 260 also exert an upward force on the gripper 98, ensuring firm engagement between the conical surfaces of the shank 106 and of the seat 258.

FIG. 18 also shows the engagement between the angular locating pin 112 of the gripper 98 and a seat 270 of the rotary body 178. An annular spring 271 is interposed between the seat 270 and the pine 112 to take up play.

The Bending Machine

FIGS. 20 to 27 show the bending machine used in the system according to the present invention.

Figure 20:
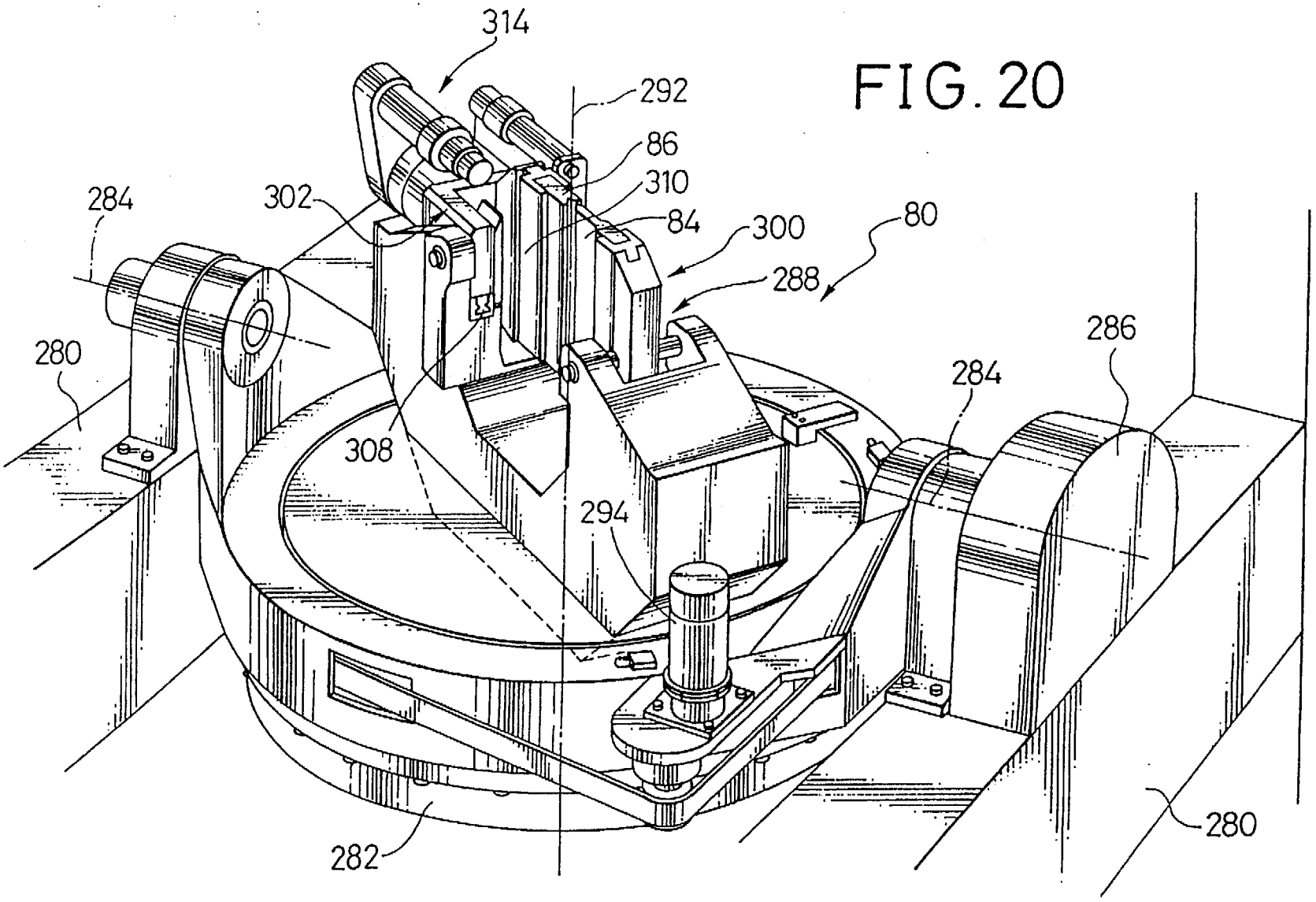
FIGS. 20 to 27 show the bending machine indicated by the arrow XX in FIG. 1 and, more precisely.
Figure 21:
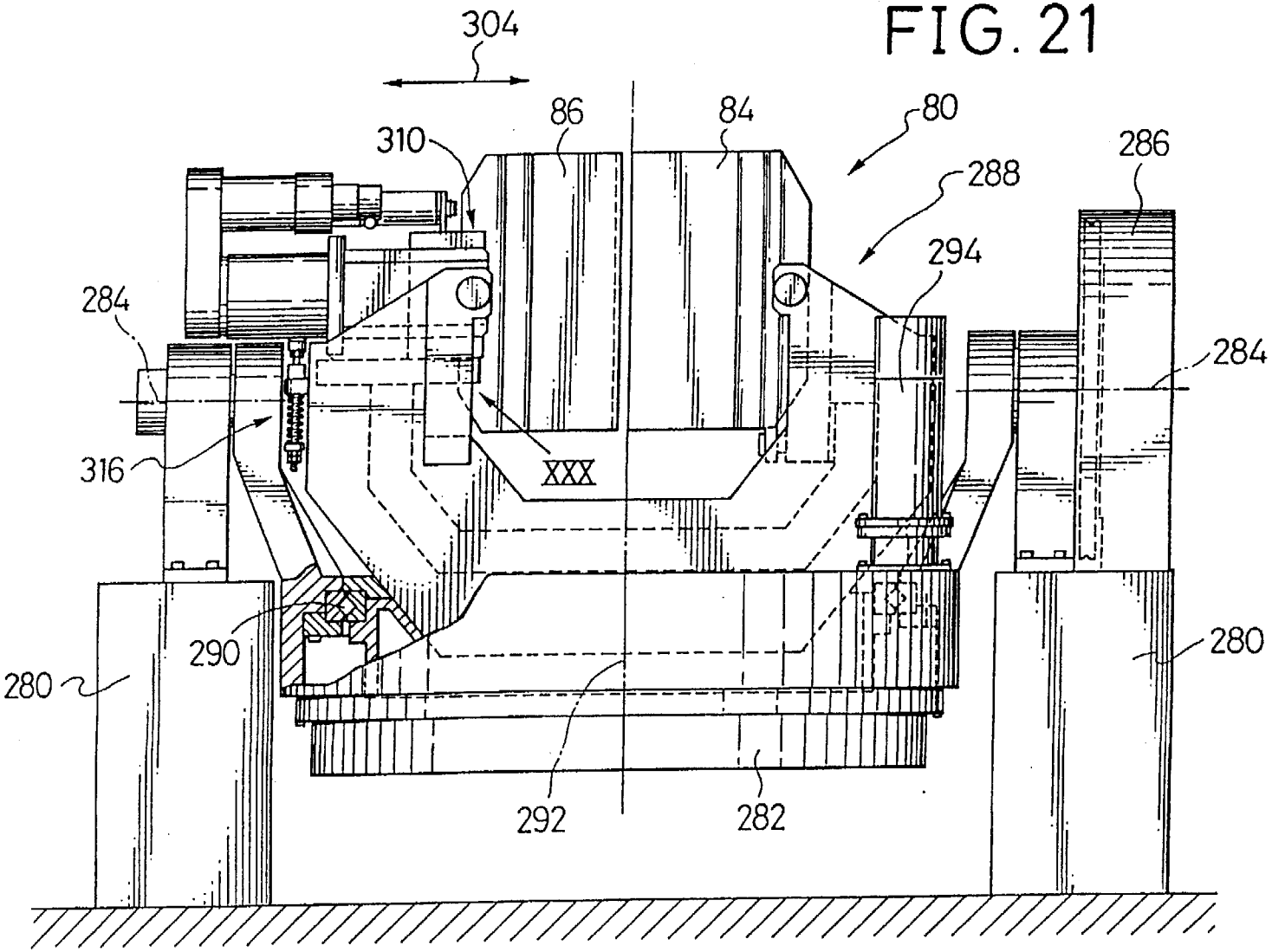
Figure 22:
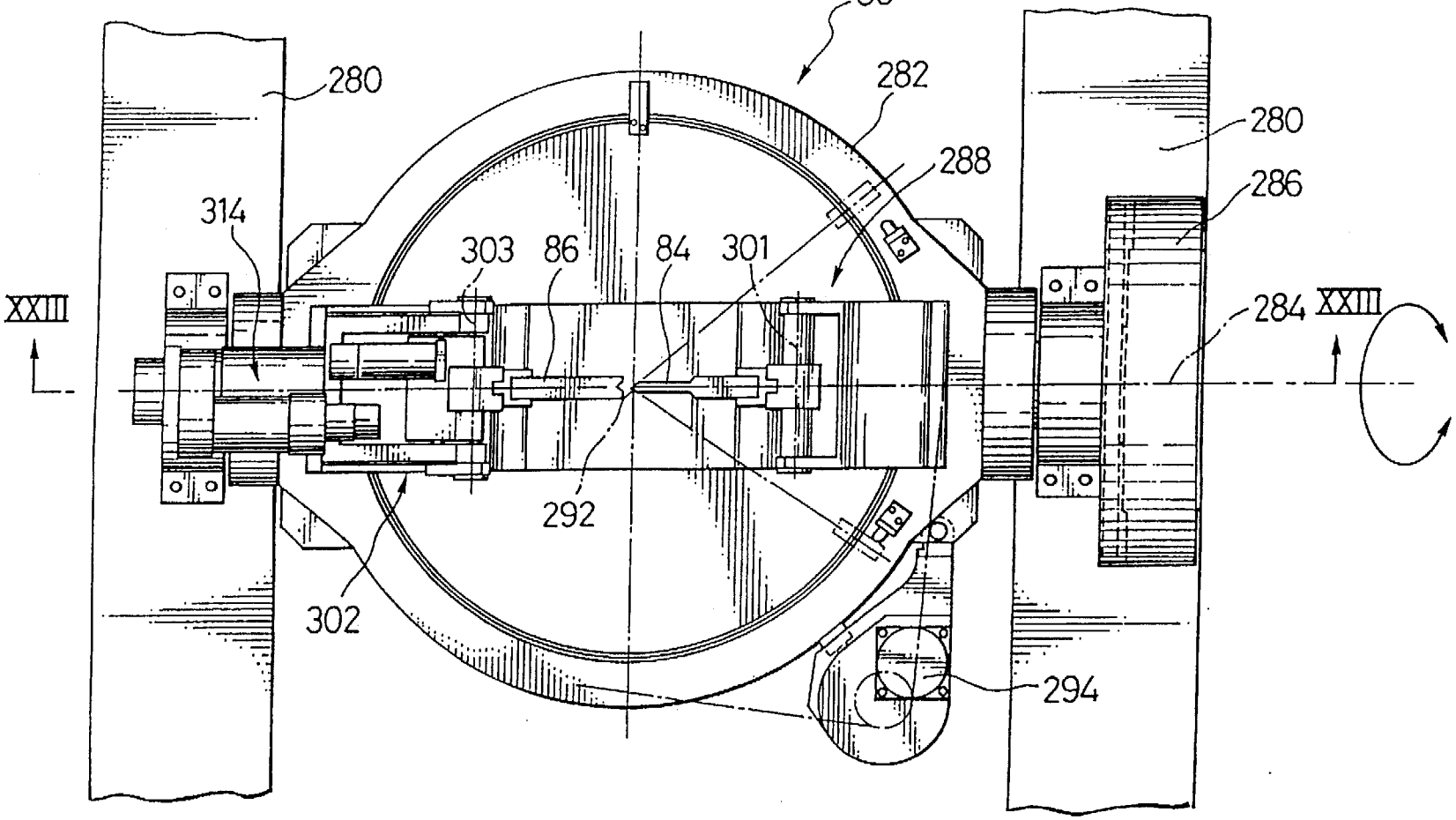

With reference to FIGS. 20 to 22 in particular, the bending machine 80 comprises a fixed base 280 carrying a cradle 282 which is pivotable relative to the fixed base 280 about a horizontal axis 284. The cradle 282 is pivoted about the axis 284 by a numerically-controlled motor 286.

A tool-holder structure 288 is rotatably mounted on the cradle 282 by means of a thrust bearing 290 (FIG. 21), the axis of rotation 292 of which coincides with the bending line defined by the vertex of the V-shaped punch 84. The tool-holder structure 288 is rotated about the bending line 292 by a numerically-controlled motor 294.

The rotations of the tool-holder structure 288 about the axes 292 and 284 enable the punch-die unit to be placed in any position relative to the piece to be bent. Moreover, during the execution of each bend, the punch-die unit moves under the control of a predetermined program, following the natural movement of the flange of the piece due to the bending action. For a detailed description of the operation principle of the bending machine 80, reference should be made to U.S. Pat. No. 4,991,422 already mentioned above.

Figure 23:
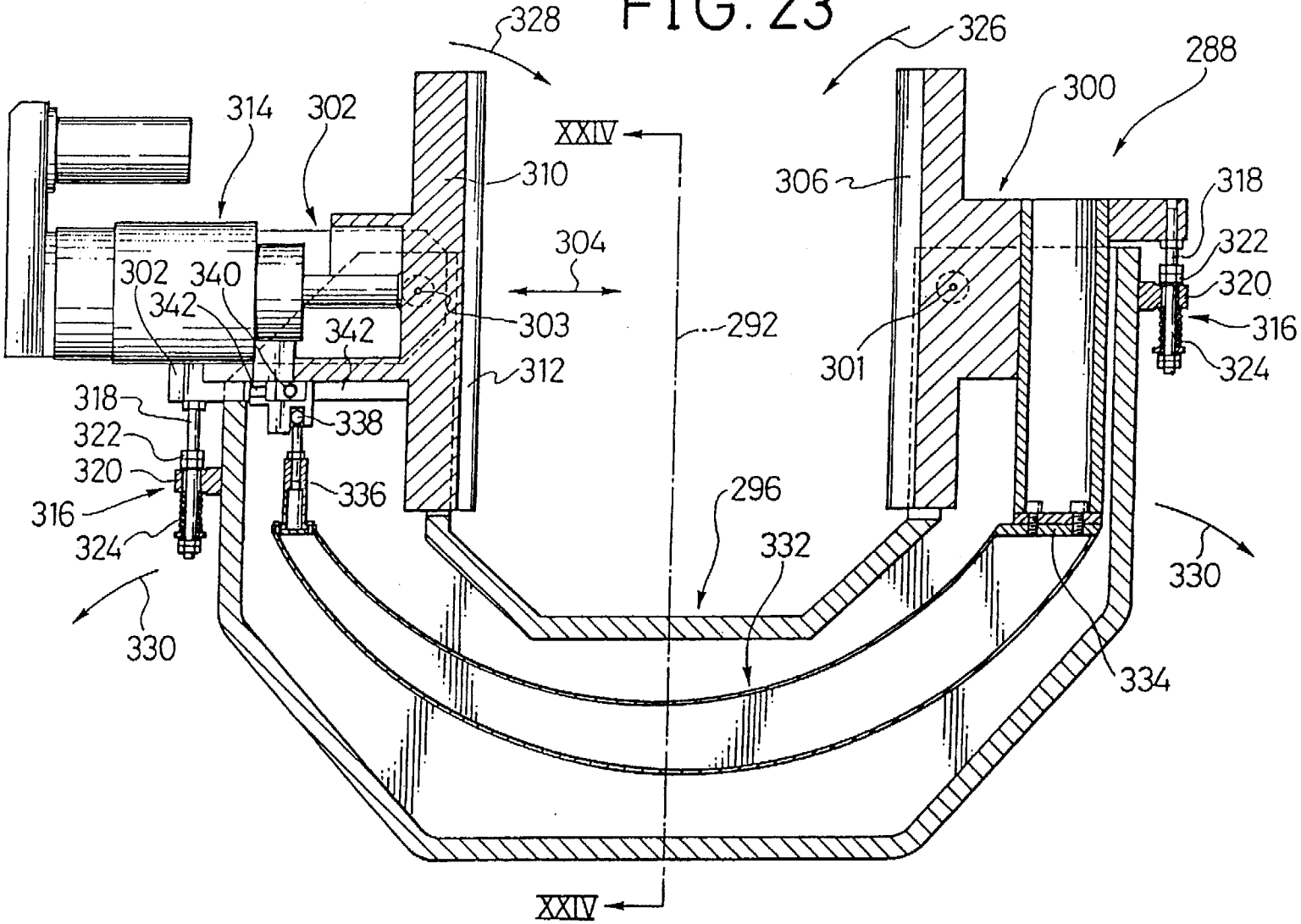
Figure 24:
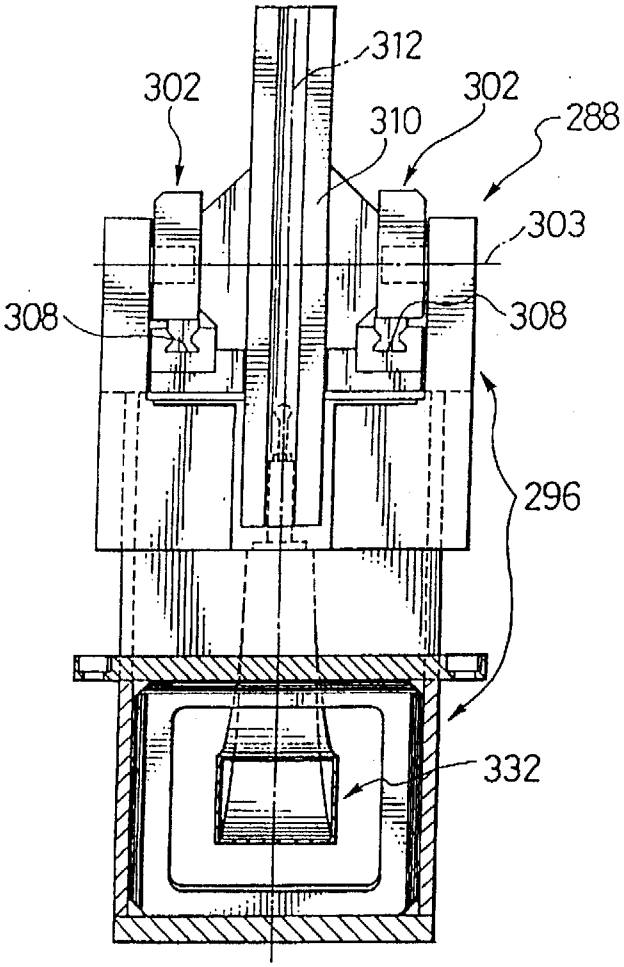

With reference now to FIGS. 23 and 24, the tool-holder structure 288 comprises a strong, hollow C-shaped section 296 to the ends of which two pivoting supports 300, 302 (also visible in FIG. 20) are articulated. The two supports 300, 302 are articulated to the C-shaped section 296 about axes 301, 303 perpendicular to the bending plane which is defined as the plane passing through the bending line 292 and through the direction of the relative movement of the tools of the bending machine, which is indicated by the double arrow 304 in FIG. 23. The pivoting support 300 is intended to house the punch 84 and has a portion 306 having means which will be described in detail below for the rapid attachment of the punch.

The pivoting support 302, on the other hand, has guides 308 (visible in FIG. 24), along which a slide 310, movable along the axis indicated by the arrow 304, can slide. The slide 310 has a portion 312 which is similar to the portion 306 of the pivoting support 300, and has means for the rapid attachment of the die 86. The travel of the slide 310 relative to the pivoting support 302 is brought about by an actuator 314 carried by the pivoting support 302 and having two numerically-controlled electric motors, of which one brings about an approach travel of the slide 310 which is carried out at high speed and with low thrust and the second brings about the bending stroke which is carried out at low speed and with high thrust (of the order of 7–8 t). The actuator 314 is described in detail in international patent application No. W092/12362.

As can be seen in FIG. 23, each pivoting support 300, 302 is associated with a locating device 316 which can exert a resilient force on the respective pivoting support 300, 302, tending to keep the support in a predetermined position relative to the C-shaped section 296. Each locating device 316 comprises a rod 318 which is fixed to the respective pivoting support 300, 302 and extends with clearance through the hole in a step 320 fixed to the C-shaped section 296. Screwed onto the rod 318 is a pair of nuts 322 the positions of which are adjustable along the axis of the rod 318, and which define a stop surface cooperating with the fixed stop 320. The nuts 322 are urged into abutment against the respective stop 320 by the force produced by a helical compression spring 324 coaxial with the rod 318. It will be appreciated that the locating devices 316 allow the pivoting supports 300 and 302 to pivot solely in the senses indicated by the arrows 326 and 328 in FIG. 23, pivoting in the opposite senses being prevented by the contact between the nuts 322 and the respective steps 320.

The purpose of the arrangement described above is to ensure that the deformation of the C-shaped section 296 brought about by the bending load does not compromise the precision of the bend. In fact, the C-shaped section 296 tends to open out under the effect of the bending stress, deforming resiliently in the senses indicated by the arrows 330 in FIG. 23. The same bending stress acting on the pivoting supports 300, 302, however, ensures that they remain in their original positions, so that the vertices of the punch and of the die remain constantly parallel to each other and to the theoretical bending line 292.

An auxiliary measurement structure, indicated 332, disposed within the C-shaped section 296, has an arcuate profile with a tapered cross-section. A first end 334 of the measurement structure is fixed rigidly to the pivoting support 300 and a second end 336 is connected, by means of a spherical coupling 338, to an optical position-measuring instrument 340 which is slidable on a guide 342 carried by the pivoting support 302. The measuring instrument 340 faces an optical mark 342 fixed to the slide 310. Naturally, the positions of the measuring instrument 340 and of the optical mark 342 could be reversed with the mark connected to the auxiliary structure and the reader instrument connected to the slide 310.

This arrangement enables the actual relative travel of the two bending tools to be measured regardless of the magnitudes of the deformations of the C-shaped section 296 brought about by the bending load. The measurements supplied by the instrument 340 are used to control the numerically-controlled motors of the actuator 314 and of bending machine 80 which, as seen above, follow the movement of the flange of the piece.

As has been seen, the deformations of the C-shaped section 296 affect neither the precision of the bend (by virtue of the pivotable mounting of the bending tools on the C-shaped section 296) nor the correct measurement of the relative spacing of the bending tools, by virtue of the measurement structure 332 which is independent of the C-shaped section 296. The C-shaped section 296 can consequently be of a size such that it is quite light, which is extremely advantageous, given that the tool-holder structure 288 is moved with rapid accelerations.

The device for the rapid engagement of the bending tools on the tool-holder structure 288 will now be described with reference to FIGS. 25, 26 and 27. Only the device for rapid engagement between the die and the slide 310 will be described, since the rapid engagement device for the punch is identical thereto, with the sole difference that the engagement device is disposed in the pivoting support 300 instead of in the body of the slide 310.

Figure 25:
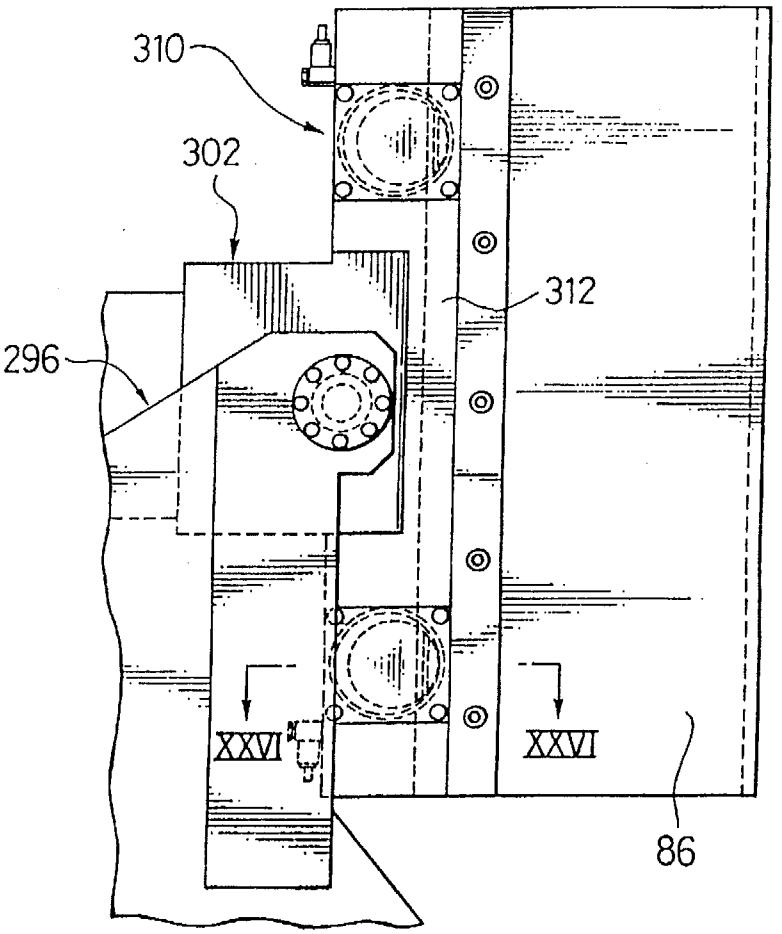
Figure 26:
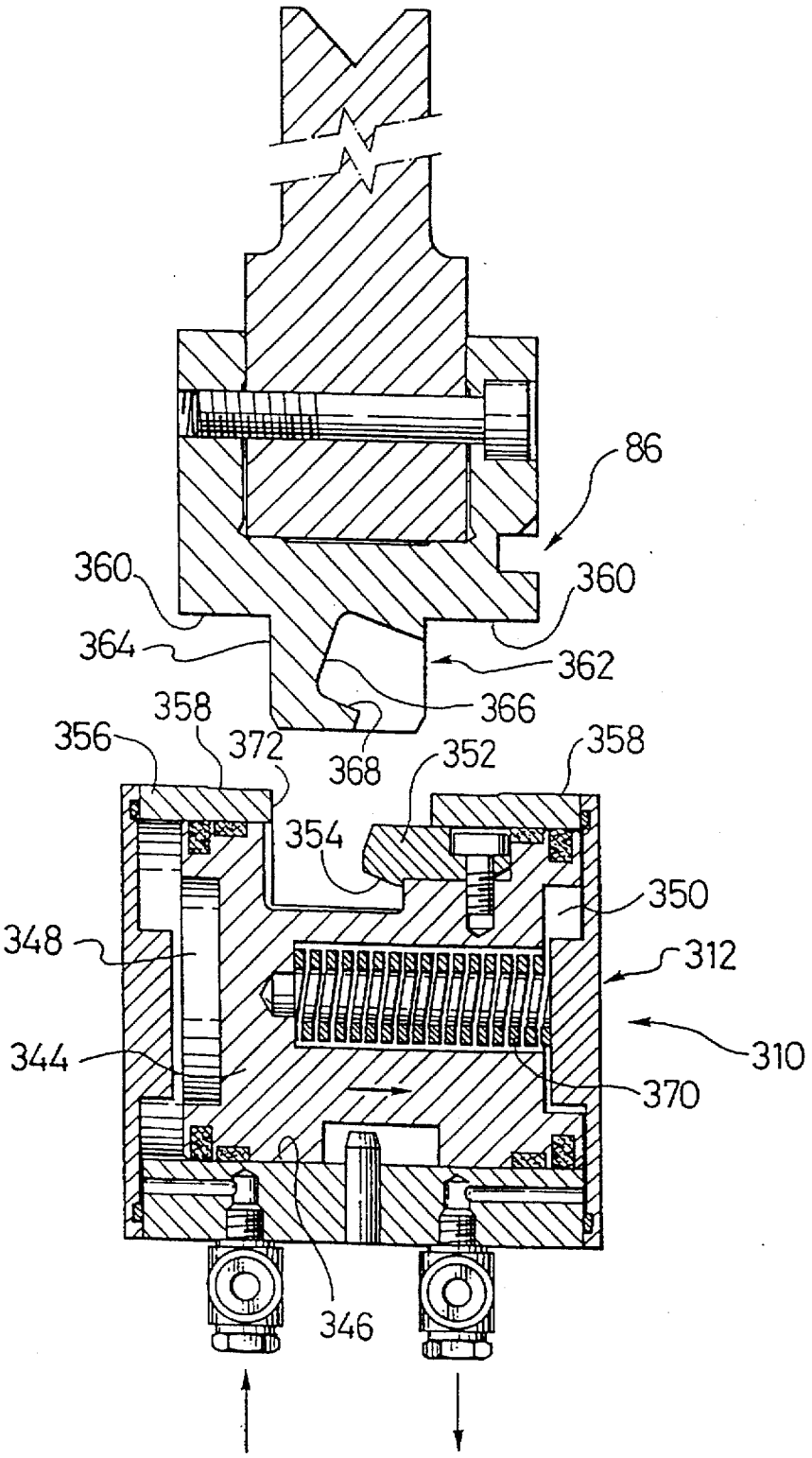
Figure 27:
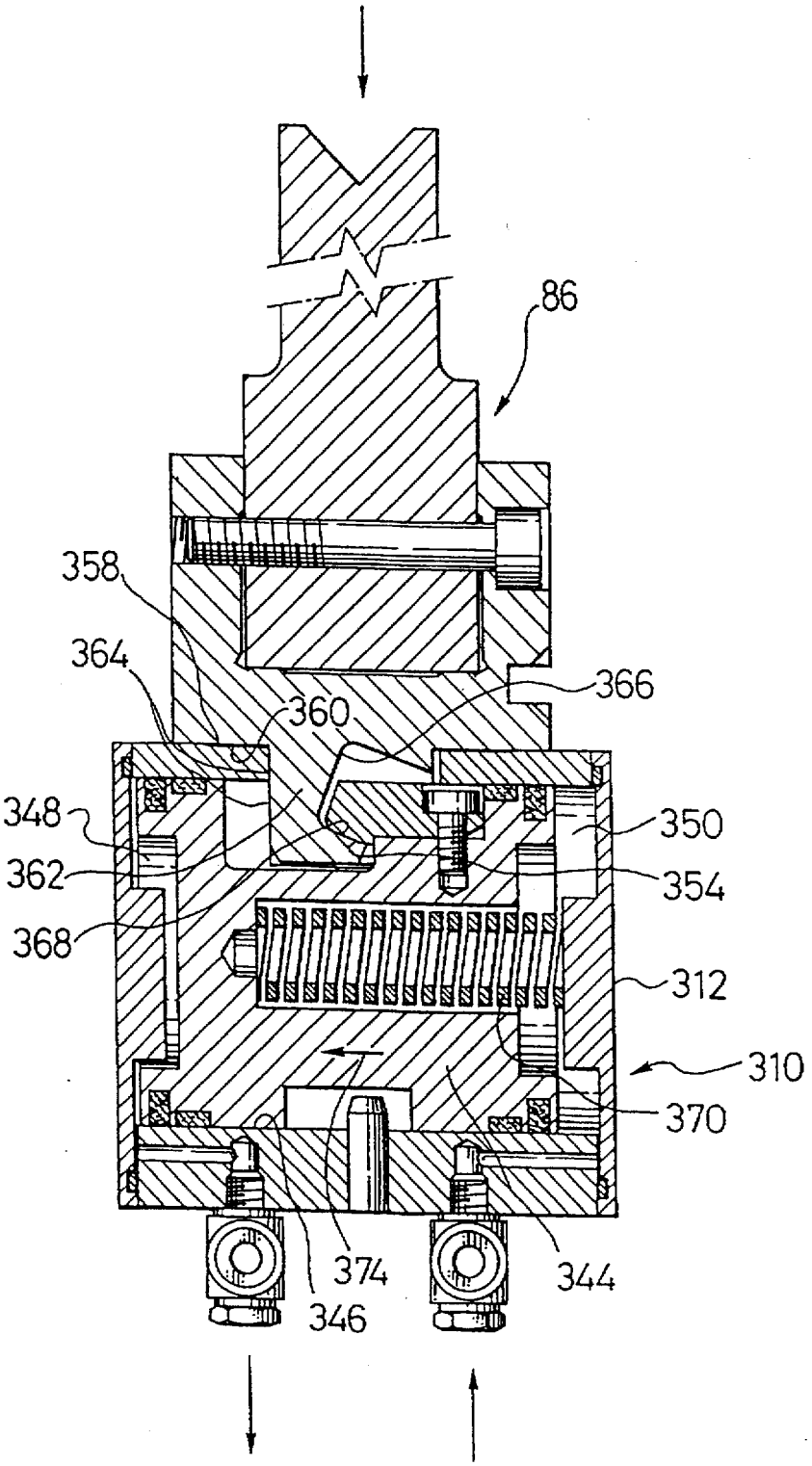

With reference to FIGS. 26 and 27, which are sections taken on the line XXVI—XXVI of FIG. 25, on an enlarged scale, a piston, indicated 344, is movable in a chamber 346 in which two regions 348 and 350 for supply with pressurized fluid are defined and are supplied in order to bring about the release and the engagement of the die 86, respectively. An engagement tooth 352 having a wedge-shaped surface 354 is fixed rigidly to the piston 344.

The slide 310 has a plate 356 with flat bearing surfaces 358 against which corresponding surfaces 360 of the die 86 bear. A hole with a locating surface 372 is formed in the plate 356. The die 86 has a shank 362 having a locating surface 364 and a recess 366 with an inclined surface 368 for cooperating with the wedge-shaped surface 354 of the engagement tooth 352.

A helical compression spring 370 interposed between the piston 344 and an internal end wall of the cavity 346 urges the piston 344 towards the engagement position shown in FIG. 27. Starting from the configuration of FIG. 26, in order to engage the die 86, pressurized fluid is sent to the supply region 348 so as to move the piston 344 against the action of the spring 370. The displacement of the engagement tooth 352 creates a space for the insertion of the shank 362 in the hole in the plate 356. The supply of fluid to the region 348 is then cut off but the region 350 is supplied, thus generating a force which is added to that generated by the spring 370, causing the piston 344 to move in the direction indicated by the arrow 374 in FIG. 27. The purpose of the spring 370 Is to ensure that the tool 86 remains connected to the portion 312 even if the supply of pressurized fluid to the region 350 should accidentally fail. The inclined surfaces 368 and 354 generated an oblique engagement force having a component parallel to the bending plane which keeps the flat surfaces 360 of the die 86 in contact with the flat surfaces 358 of the plate 356. The engagement force also has a component perpendicular to the bending plane which keeps the locating surface 364 in contact with the corresponding locating surface 372 of the plate 356. This enables precise and highly repeatable positioning of the bending tools relative to the slide 310 and relative to the pivoting support 300.

The Device For The Automatic Replacement Of The Bending Tools

As has been seen in the general description of the system, the replacement of one or both the tools of the bending machine is effected by means of an automatic tool-changing device constituted by a cartesian robot which can move freely between a tool store and the bending machine.

The tool-gripping head of the tool-changing robot and the method followed in order to replace the tools of the bending machine will now be described with reference to FIGS. 28 to 36.

Figure 28:
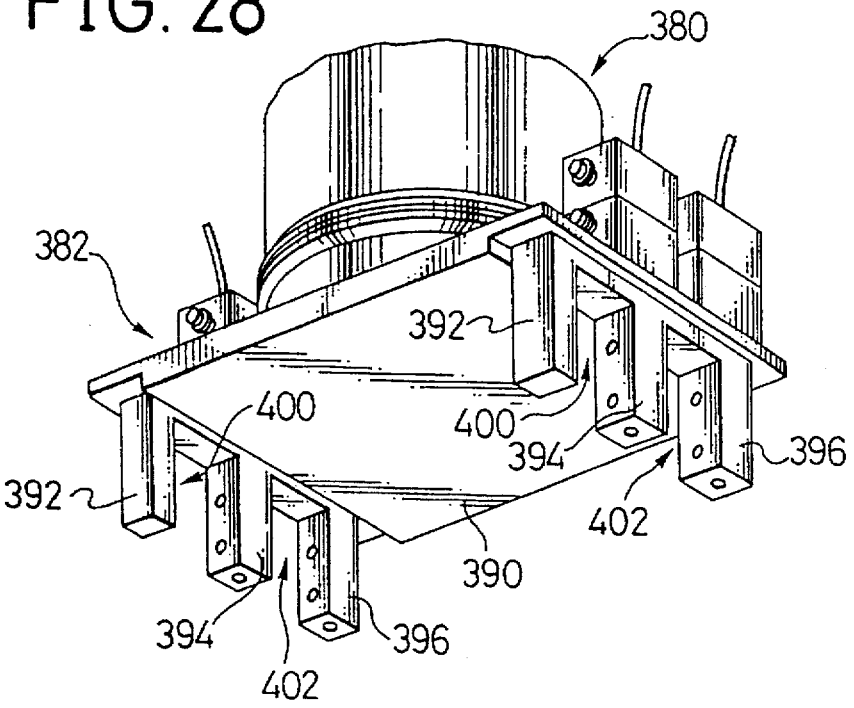
FIGS. 28–36 show the tool-gripping head, indicated by the arrow XXVIII in FIG. 1, of a device for automatically replacing the tools of a bending machine and, more precisely.
Figure 29:
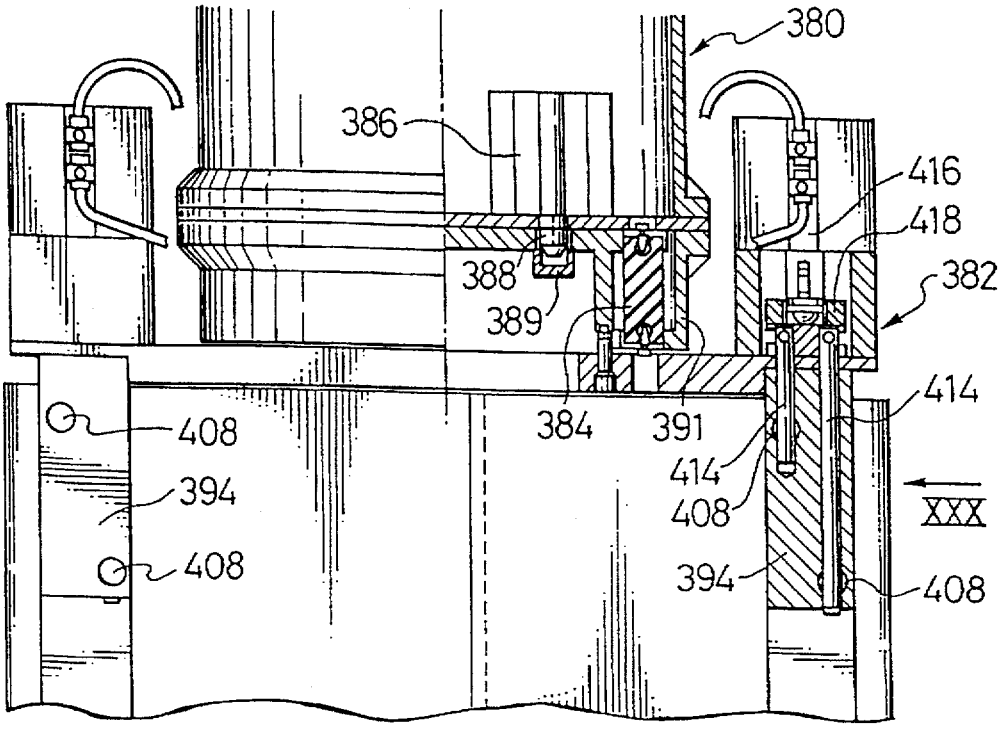
Figure 30:
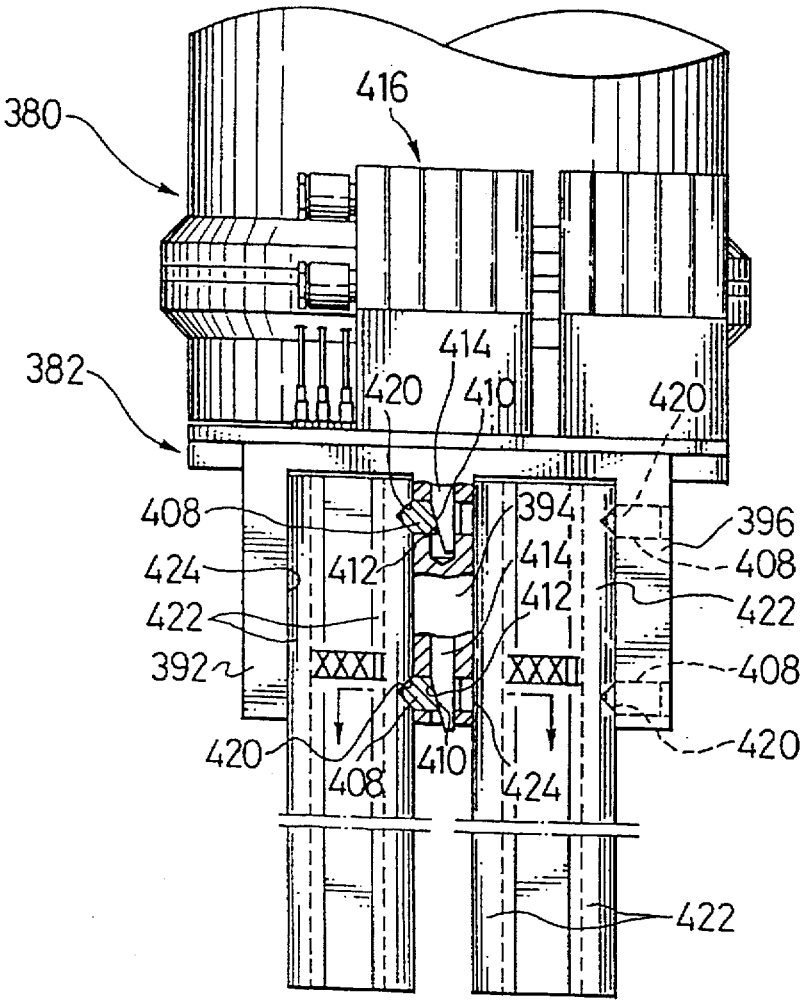

With reference initially to FIGS. 28 to 30, the movable device of the tool-changing robot is indicated 380 and carries a head 382 for gripping the tools. As can be seen in FIG. 29, the head 382 is connected to the movable device 380 by means of a plurality of resilient elements constituted by blocks 384 of elastomeric material which allow the head 382 limited freedom to float relative to the movable device of the robot. A clamping device, schematically indicated 386, has three movable clamping members 388, only one of which is visible in the drawing, and which are intended to clamp the head 382 with respect to its freedom to float. The clamping members 388 engage respective seats 389 in an element 391 fixed to a plate 390 (FIG. 28) of the head 382.

The resilient suspension system of the head 382 is useful during the tool-changing sequence to compensate for any errors in the relative positioning of the robot and the bending machine, and the suspension can be clamped during the high-speed movements of the robot, to prevent oscillations of the head.

As can be seen in FIG. 28 in particular, the gripping head 382 comprises the plate 390 carrying three pairs of gripping fingers 392, 394 and 396 which are fixed relative to the plate 390 and between which two pairs of seats 400 and 402 are defined for housing two pairs of bending tools, each constituted by a punch and a die.

Figure 31:
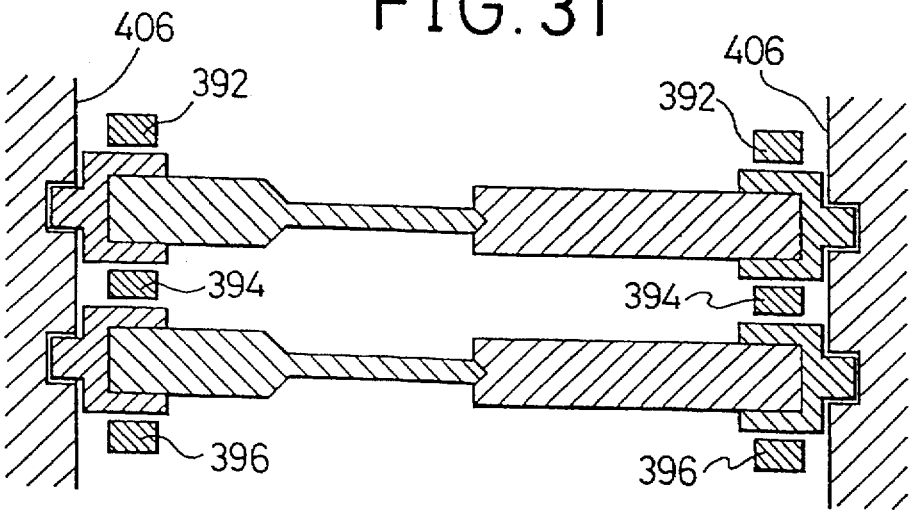

As can be seen in FIG. 31, the bending tools are arranged in punch-die pairs, each contained in a vertical plane, in a storage structure with a rack, schematically indicated 406. Each punch-die pair is sufficiently spaced from the adjacent pair to allow a pair of gripping fingers to be inserted between them, as shown schematically in FIG. 31.

With reference to FIGS. 29 and 30, each of the gripping fingers 394 and 396 comprises a device for engaging the tools, comprising a pair of pistons 408 with rounded heads, each of which has a wedge-shaped surface 410 cooperating with a corresponding wedge-shaped surface 412 of a slidable operating rod 414. The two rods 414 of each gripping finger are operated by a single actuator 416 by means of a pivoting plate 418. A downward movement of the rods 414 causes the ends of the pistons 408 to emerge and engage corresponding recesses 420 in a base portion 422 of the bending tool. The base portion 422 is thus pressed against the surface 424 of the opposite gripping finger (FIG. 30).

Figure 32:
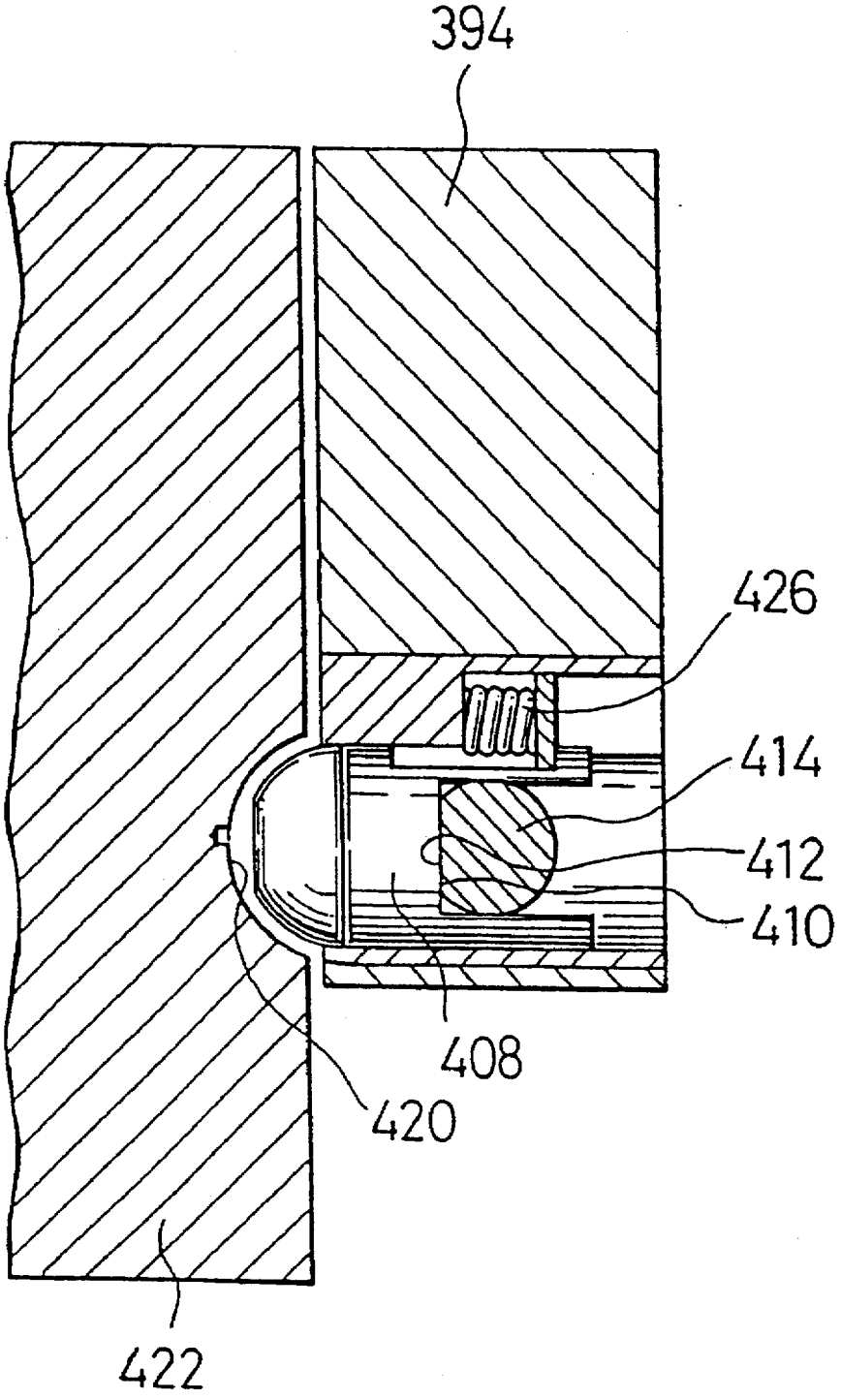

As can be seen in the detail of FIG. 32, each piston 408 is associated with a biasing spring 426 which, as a result of the raising of the rod 414, causes the piston 408 to re-enter the gripping finger 394 so as to release the base portion 422 of the tool.

The fact that the punch and the die are gripped between two pairs of gripping finger enables the two tools to be kept in the same configuration in which they are mounted on the bending machine, which greatly simplifies tool-replacement operations.

The sequence for the replacement of the tools in the bending machine will now be described with reference to FIGS. 33 to 36.

The portions of the bending machine which are movable towards each other are indicated 430 and 432 and a first pair of tools which is connected to the two portions 430, 432 of the bending press initially is indicated 434. A pair of replacement tools is indicated 436. The tool-changing robot is first brought near to the tool-holding store and picks up a pair of replacement tools 436, extracting them from the rack structure 406 from above after it has gripped them between two pairs of gripping fingers 394, 396. This step is normally carried out whilst the bending machine is carrying out its normal bending cycle with the tools 434.

Figure 33:
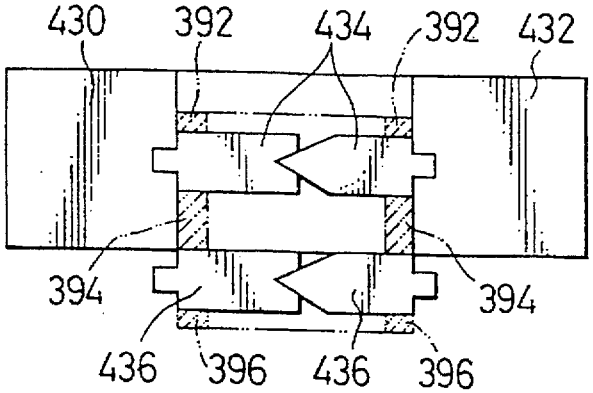

In order to replace the tools, the bending machine is brought to a configuration in which the bending plane extends vertically and in which the punch and the die are in contact with each other (FIG. 33). The gripping head of the tool-changing robot is made to descend from above so as to position the first pair of tools 434 between the gripping fingers 392, 394, as shown in FIG. 33.

Figure 34:
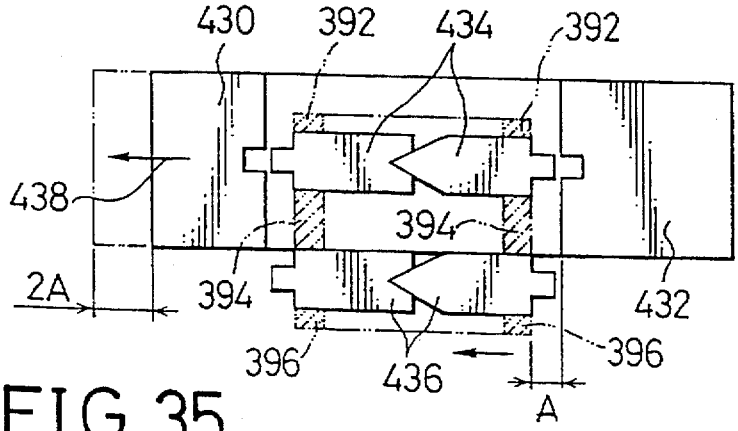

After it has gripped the tools 434 by means of the engagement devices described above, the rapid engagement means which connect the tools 434 to the two portions 430, 432 of the bending press are released. The two portions 430, 432 are then moved apart, as shown in FIG. 34, releasing the first pair of tools 434. This is achieved by means of a displacement of the movable part 430 by a distance 2A in the direction indicated by the arrow 438 in FIG. 34, together with a displacement of the tool-holder head by a distance A in the same direction.

Figure 35:
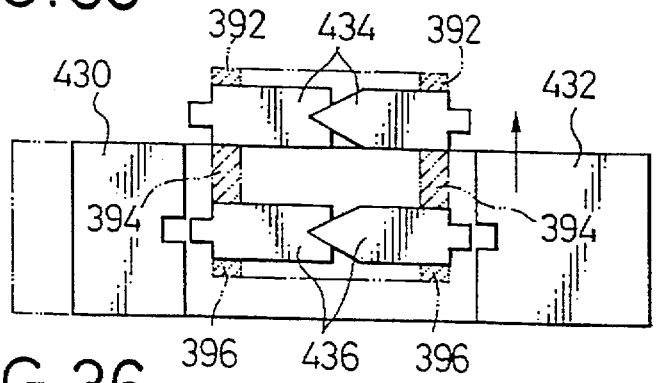
Figure 36:
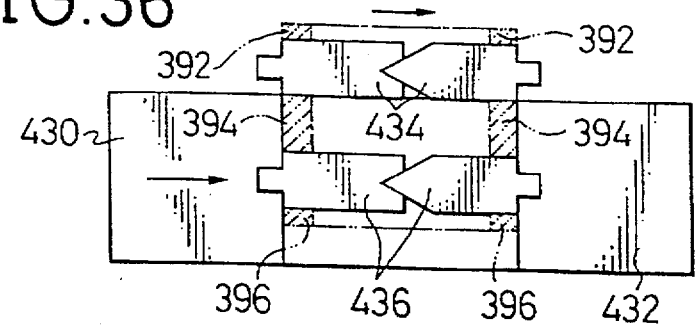

The tool-holder head is then moved until the pair of replacement tools 436 is brought into correspondence with the rapid engagement devices of the bending machine (FIG. 35). Finally, the portions 430 and 432 of the bending machine are brought together again and the rapid engagement devices are activated and connect the replacement tools 436 to the tool-holder structure of the bending machine. When the engagement of the replacement tools 436 on the tool-holder structure has been completed, the engagement means of the gripping fingers 394 and 396 are disengaged.

The sequence described may also be carried out in a slightly modified form to replace only one of the bending tools (generally the punch).

The fact that the tool-changing robot 60 is independent of the manipulator 64 for the pieces of sheet metal and of the bending machine 80 enables the tool store 62 to be equipped simultaneously with the normal working cycle of the system.

In FIG. 1, an interface position, indicated 440, is disposed within the reach of the tool-changing robot and can be reached by an operator without danger of being struck by moving parts. The operator places the tools in the interface position and removes them therefrom without interrupting the working cycle of the system and the tool-changing robot takes the tools from the interface position and positions them in the store 62. The robot also places the tools which are not used in a certain bending cycle in the interface position, so as to leave space free in the store 62 for the tools actually being used.

I claim:

1. A manipulator for gripping and moving an initially flat piece of sheet metal to be subjected to bending operations by means of a bending machine, comprising a suspension head which can allow the piece to perform small movements in space with every degree of freedom except for rotation about an axis perpendicular to the plane of the undeformed piece, wherein the suspension head has rapid engagement and release means for gripping and releasing a gripper previously fitted on to the piece to be worked, said suspension head comprising:

a base fixed to a movable structure of the manipulator, a suspension body which can perform movements of limited extent in a substantially vertical direction relative to the base, a first pivoting element articulated to the suspension body about a first horizontal axis, a slide slidable relative to the first pivoting element along a direction parallel to the first horizontal axis, a second pivoting element articulated to the slide about a second horizontal axis parallel to the first, a rotary body connected to the second pivoting element in a manner such that it can rotate freely about an axis perpendicular to the second horizontal axis, wherein the rotary body is carried, through the second pivoting element, the slide, the first pivoting element, and the suspension body, by the base so as to be prevented from pivoting about a horizontal axis perpendicular to the first horizontal axis.

2. A device according to claim 1, comprising at least one pair of engagement fingers which are movable axially in a conical seat housing a shank of the gripper and which cooperate with a seat of the gripper.

3. A manipulator for gripping and moving an initially flat piece of sheet metal to be subjected to bending operations by means of a bending machine, comprising a suspension head which can allow the piece to perform small movements in space with every degree of freedom except for rotation about an axis perpendicular to the plane of the undeformed piece, wherein the suspension head has rapid engagement and release means for gripping and releasing a gripper previously fitted on to the piece to be worked, wherein the suspension head comprises:

a base fixed to a movable structure of the manipulator, a suspension body which can perform movements of limited extent in a substantially vertical direction relative to the base, resilient balancing means interposed between the base and the suspension body, a first pivoting element articulated to the suspension body about a first horizontal axis, a slide slidable relative to the first pivoting element along a direction parallel to the first horizontal axis, a second pivoting element articulated to the slide about a second horizontal axis parallel to the first, a rotary body connected to the second pivoting element in a manner such that it can rotate freely about an axis perpendicular to the second horizontal axis.

4. A device according to claim 3, wherein the suspension body is connected to the base by means of a four-bar linkage mechanism.

5. A device according to claim 3, wherein the resilient balancing means comprise a spring with preloading which is adjustable in dependence on the weight of the piece of sheet-metal to be picked up.

6. A device according to claim 3, wherein it comprises a plurality of clamping and biasing devices for restricting the degrees of freedom of the suspension head and returning the elements constituting the suspension head to a predetermined attitude.

7. A manipulator for gripping and moving an initially flat piece of sheet metal to be subjected to bending operations by means of a bending machine, comprising a suspension head which can allow the piece to perform small movements in space with every degree of freedom except for rotation about an axis perpendicular to the plane of the undeformed piece, wherein the suspension head has rapid engagement and release means for gripping and releasing a gripper previously fitted on to the piece to be worked, wherein the suspension head comprises:

a base fixed to a movable structure of the manipulator, a suspension body which can perform movements of limited extent in a substantially vertical direction relative to the base, resilient balancing means interposed between the base and the suspension body, a first pivoting element articulated to the suspension body about a first horizontal axis, a slide slidable relative to the first pivoting element along a direction parallel to the first horizontal axis, a second pivoting element articulated to the slide about a second horizontal axis parallel to the first, a rotary body connected to the second pivoting element in a manner such that it can rotate freely about an axis perpendicular to the second horizontal axis, and further comprising rapid engagement and release means housed in the rotary body.

8. A manipulator for gripping and moving an initially flat piece of sheet metal to be subjected to bending operations be means of a bending machine, comprising a suspension head which can allow the piece to perform small movements in space with every degree of freedom except for rotation about an axis perpendicular to the plane of the undeformed piece, wherein the suspension head has rapid engagement and release means for gripping and releasing a gripper previously fitted on to the piece to be worked, and at least one pair of engagement fingers which are movable axially in a conical seat housing a shank of the gripper and which cooperate with a seat of the gripper, wherein the engagement fingers are carried by a movable piston operated by pressurized fluid, and cooperate with a fixed shaft which moves the engagement fingers apart resiliently, the engagement fingers also being able to impart to the gripper a force which tends to insert the shank in the conical seat.

9. A manipulator for gripping and moving an initially flat piece of sheet metal to be subjected to bending operations by means of a bending machine, comprising a suspension head which can allow the piece to perform small movements in space with every degree of freedom except for rotation about an axis perpendicular to the plane of the undeformed piece, wherein the suspension head has rapid engagement and release means for gripping and releasing a gripper previously fitted on to the piece to be worked, wherein the suspension head comprises:

a base fixed to a movable structure of the manipulator, a suspension body which can perform movements of limited extent in a substantially vertical direction relative to the base, resilient balancing means interposed between the base and the suspension body, a first pivoting element articulated to the suspension body about a first horizontal axis, a slide slidable relative to the first pivoting element along a direction parallel to the first horizontal axis, a second pivoting element articulated to the slide about a second horizontal axis parallel to the first, a rotary body connected to the second pivoting element in a manner such that it can rotate freely about an axis perpendicular to the second horizontal axis, a plurality of clamping and biasing devices for restricting the degrees of freedom of the suspension head and returning the elements constituting the suspension head to a predetermined attitude, wherein each clamping and biasing device is interposed between a relatively fixed part and a relatively movable part and comprises a chamber in one of the parts, first and second discs being slidable and movable towards each other in the chamber under the action of pressurized fluid, and being able to clamp between them an appendage carried by the other of the relatively fixed and movable parts.

10. A device according to claim 9, wherein a first disc is urged against a shoulder fixed to the part in which the chamber is formed, by a force which is substantially double that which urges the second disc against the shoulder.

11. A device according to claim 10, wherein the first and second discs are operated by an actuator device comprising first and second pistons which are fixed together and can slide freely in the chamber, and a third piston which can slide in the chamber independently of the first two, a first pressurized-fluid supply region being defined between the first and third pistons and a second pressurized-fluid supply region being defined between the second piston and an end of the chamber.

12. A device for the automatic replacement of the tools in a bending machine, comprising a punch and a die connected to a tool-holder structure by rapid attachment means, the device comprising a movable structure carrying a tool-gripping head, which is movable along three perpendicular axes between a tool store and the bending machine, the gripping head having rapid engagement means for gripping at least one punch-die pair in the attitude in which the tools are mounted on the machine, wherein the gripping head comprises two independent pairs of gripping elements for simultaneously gripping a replacement pair of tools and a pair of tools which has been removed from the bending machine and three parallel pairs of fingers between which two pairs of seats are defined for respective pairs of tools, at least two pairs of fingers having gripping devices each comprising at least one piston which can slide transverse the respective finger between a projecting position and a retracted position.

13. A device according to claim 12, comprising a clamping device which connects the gripping head to an end portion of the movable structure and disconnects it therefrom, a resilient connecting element also being provided for connecting the tool-gripping head to the movable structure resiliently when the clamping device is disengaged.

14. A device according to claim 12, wherein the gripping head comprises two independent pairs of gripping elements for simultaneously gripping a replacement pair of tools and a pair of tools which has been removed form the bending machine.

15. A device according to claim 12, wherein the means for rapid attachment of punch or die comprises a tooth for engaging a recess formed in a shank of the punch or die, the tooth being movable in a direction perpendicular to the bending plane.

16. A device according to claim 15, wherein the shank of the punch or dies has an inclined surface for defining the recess, and the tooth is formed with a wedge shaped surface for engaging the inclined surface.

17. A device for the automatic replacement of the tools in a bending machine, comprising a punch and a die connected to a tool-holder structure by rapid attachment means, the device comprising a movable structure carrying a tool-gripping head, which is movable along three perpendicular axes between a tool store and the bending machine, the gripping head having rapid engagement means for gripping at least one punch-die pair in the attitude in which the tools are mounted on the machine, wherein the gripping head comprises two independent pairs of gripping elements for simultaneously gripping a replacement pair of tools and a pair of tools which has been removed from the bending machine, and wherein the gripping head comprises three parallel pairs of fingers between which two pairs of seats are defined for respective pairs of tools, a least two pairs of fingers having gripping devices each comprising at least one piston which can slide transverse the respective finger between a projecting position and a retracted position and a wedge-shaped element which is movable parallel to the finger in order to cause the cylinder to emerge so as to grip the tool against a facing finger.

18. A device according to claim 17, wherein the means for rapid attachment of punch or die comprises a tooth for engaging a recess formed in a shank of the punch or die, the tooth being movable in a direction perpendicular to the bending plane.

19. A device according to claim 18, wherein the shank of the punch or die has an inclined surface for defining the recess, and the tooth is formed with a wedge shaped surface for engaging the inclined surface.

* * * * *